United States Patent [19]

Muhlack

[11] Patent Number: 4,920,760

[45] Date of Patent: May 1, 1990

[54] DISPLAY BOOTH

[76] Inventor: Horst Muhlack, D-2300 St. Adde, Kiel Julien Lusterweg 23, Fed. Rep. of Germany

[21] Appl. No.: 128,660

[22] Filed: Dec. 3, 1987

[30] Foreign Application Priority Data

Dec. 3, 1986 [DE] Fed. Rep. of Germany ..... 3641354
May 1, 1987 [DK] Denmark ..... 2226/87
Oct. 31, 1987 [EP] European Pat. Off. ..... 87116029.7

[51] Int. Cl.[5] ..... A47F 3/04

[52] U.S..Cl. ..... 62/255; 49/362; 74/89.17; 312/284

[58] Field of Search ..... 312/284, 312; 62/246, 62/249, 255; 49/362; 74/89.17

[56] References Cited

U.S. PATENT DOCUMENTS 781,633 2/1905 Conner et al. ..... 312/284
944,831 12/1909 Terramorse ..... 49/362 X
1,452,558 4/1923 Jackson ..... 312/284 X
2,219,912 10/1940 Bireley ..... 62/255 X
2,321,597 6/1943 Hobbs ..... 137/533.31 X
3,171,473 2/1965 Lawler ..... 62/255 X
4,572,598 2/1986 Moore, Jr. ..... 312/284

FOREIGN PATENT DOCUMENTS 1294260 4/1961 France ..... 312/284

*Primary Examiner*—William E. Tapolcai
*Attorney, Agent, or Firm*—Peter K. Kontler

[57] ABSTRACT

A display booth wherein a support has a horizontal table beneath a light-transmitting dome which is movable up and down by a reversible electric motor so that it can afford or prevent access to goods which are displayed on the table and/or on one or more shelves on a tubular guide within the dome.

67 Claims, 13 Drawing Sheets

Fig. 8
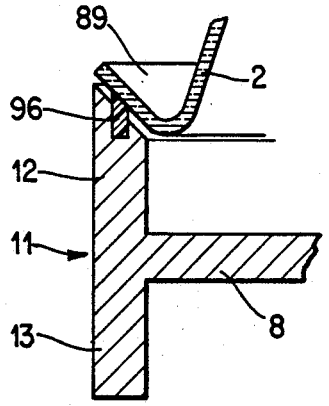
Fig. 11
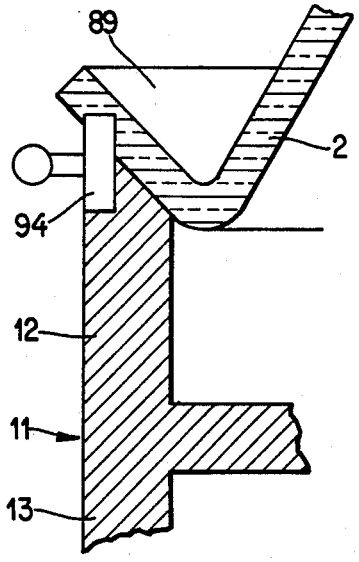
Fig. 9
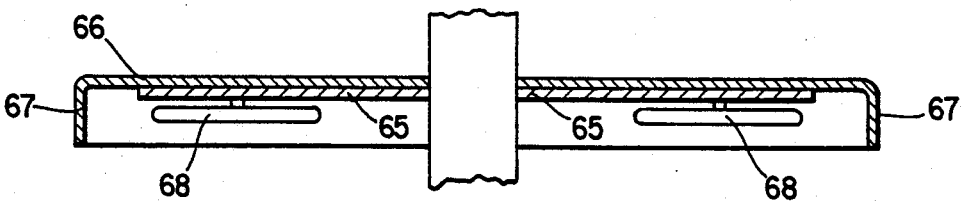
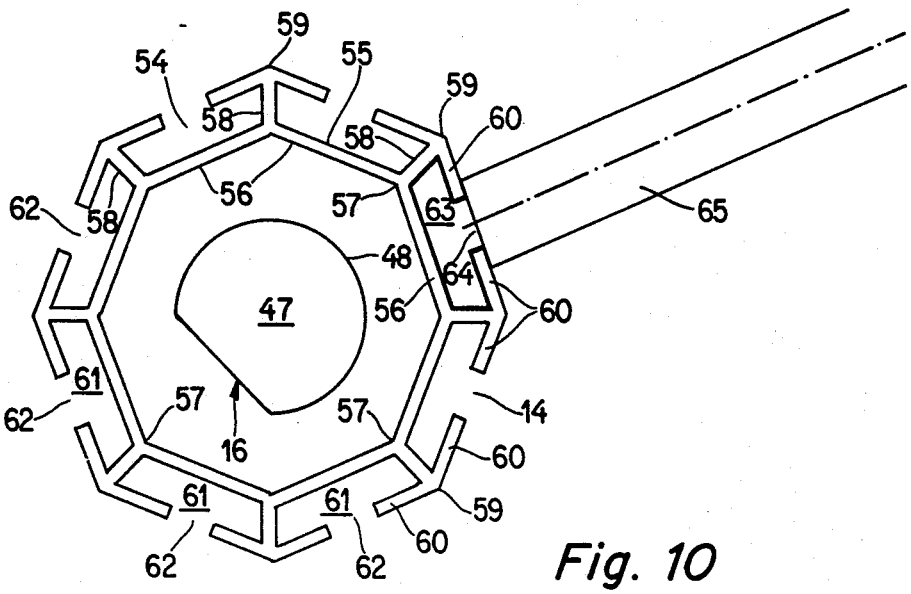
Fig. 10

Fig. 18
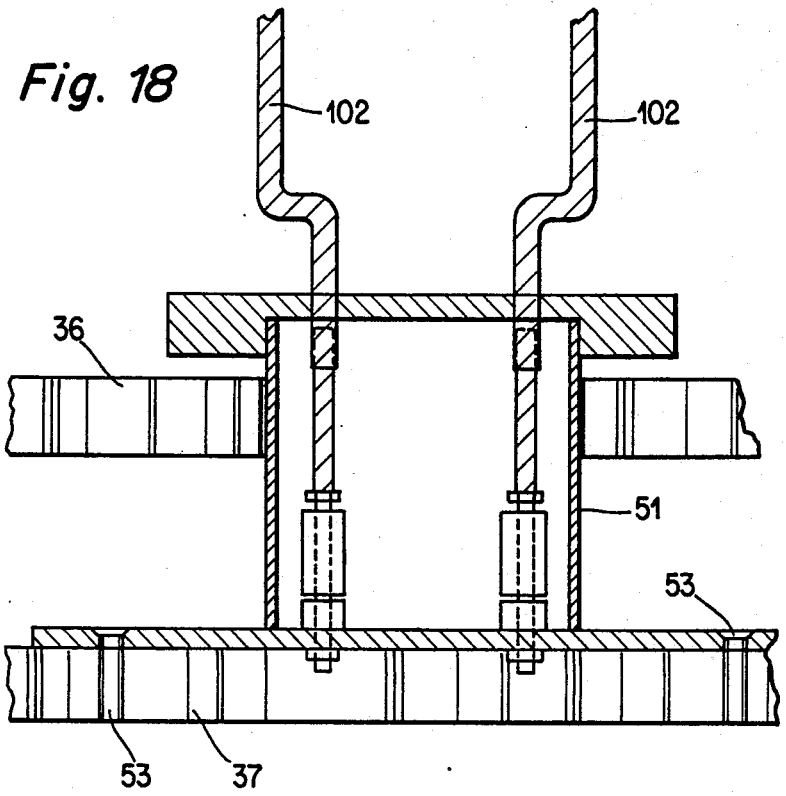
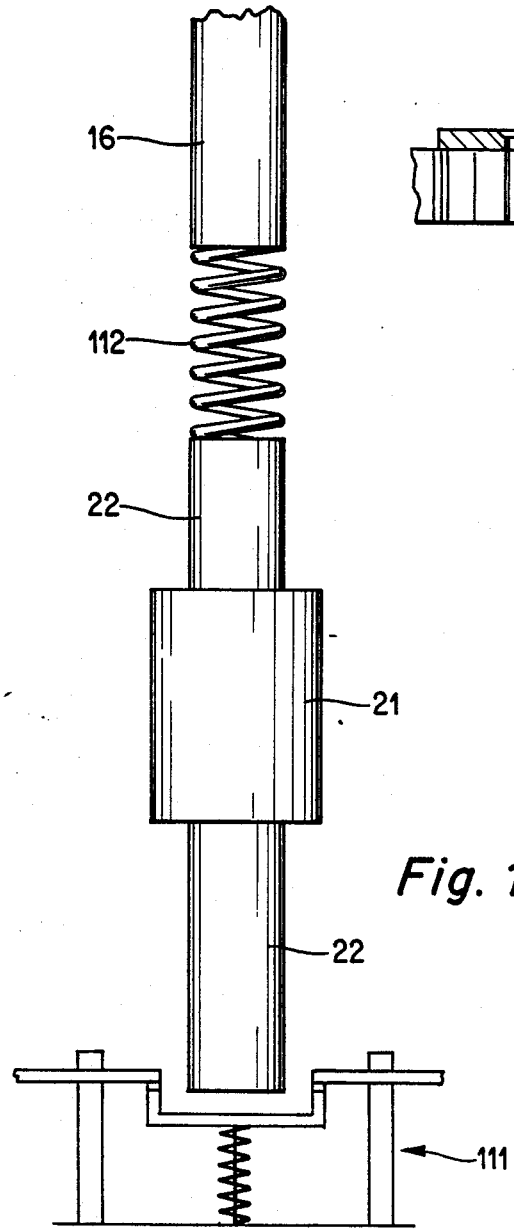
Fig. 19

Fig. 24
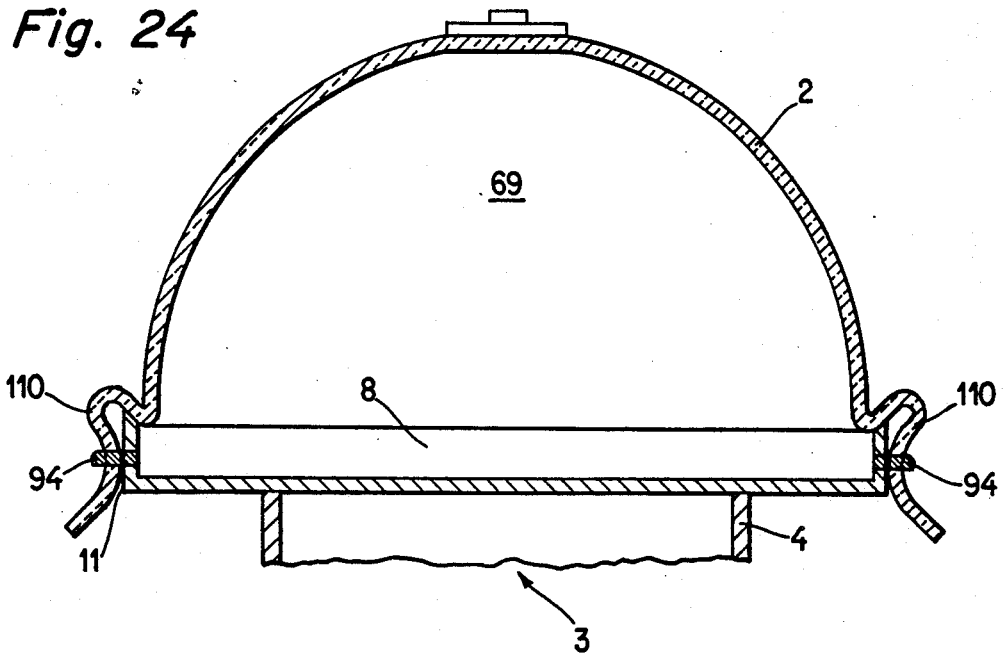
Fig. 25
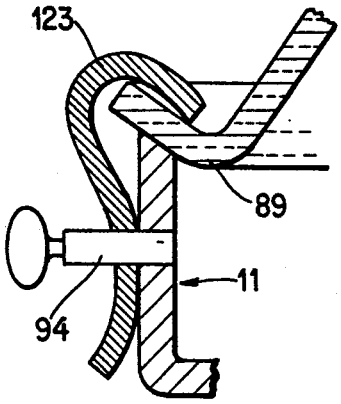
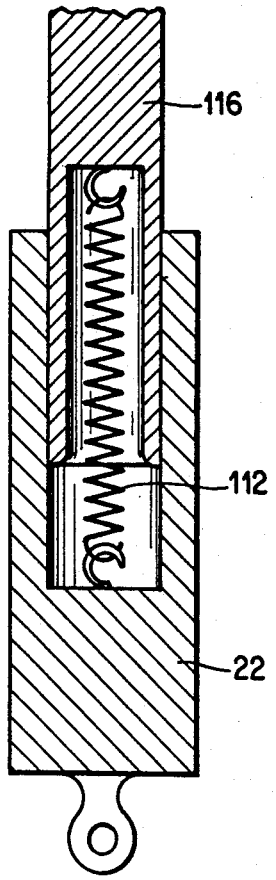
Fig. 26

DISPLAY BOOTH

BACKGROUND OF THE INVENTION

The invention relates to display booths in general, and more particularly to improvements in display booths which can be used in stores, in outdoor and/or indoor shopping malls, at exhibitions or elsewhere to display perishable or other commodities to interested members of the public.

Display booths are used in stores, in exhibition halls and elsewhere to present to the viewers a variety of goods in a manner such that the goods can be observed from many sides but that unauthorized persons cannot actually touch or remove the displayed goods. As a rule, a display booth includes at least one light-transmitting wall which surrounds or bonds a portion of or the entire space in which the goods are displayed in such a way that they remain out of reach. In many instances, the light-transmitting walls constitute or form part of or include sliding or pivotable doors which must be moved to open positions in order to enable the exhibitor of goods to gain access to the interior of the booth so as to remove the displayed objects, to insert fresh objects or to inspect, clean and/or otherwise treat the displayed objects. A drawback of doors is that they contribute to the cost of the booth as well as that their frames obscure portions of the displayed objects. Moreover, the locks for the doors detract from the appearance of the booths. In each instance, the observation of displayed goods from those sides of the booth which are not provided with doors is more convenient than from the sides which are provided with doors.

It is also known to design a display booth in such a way that a base carries a cupola which is removable by hand so that it affords access to the area for objects which are to be displayed when the cupola is returned onto and secured to the base. A drawback of such booths is that, in many instances, the displayed objects cannot be readily observed from all sides.

OBJECTS AND SUMMARY OF THE INVENTION

An object of the invention is to provide a novel and improved display booth which is constructed and assembled in such a way that the area or areas in which one or more objects are displayed to the public is or are observable from all sides and to the same extent.

Another object of the invention is to provide a display booth wherein the light-transmitting portion or portions need not be provided with sliding or pivotable doors.

A further object of the invention is to provide a display booth which can be used for exhibition of a wide variety of objects including perishable or other goods and which is of eye-pleasing appearance.

An additional object of the invention is to provide a display booth wherein authorized persons can gain access to the area for the displayed objects with little loss in time and with a minimum of effort.

Still another object of the invention is to provide the above outlined booth with novel and improved means for illuminating the displayed object or objects.

A further object of the invention is to provide a display booth which can be readily transported to and from a selected locale and wherein access to the displayed goods by unauthorized persons can be interdicted in a simple and efficient way.

An additional object of the invention is to provide a novel and improved light-transmitting component for use in the above outlined display booth.

An additional object of the invention is to provide a display booth which provides ample space for storage of accessories including controls for the illuminating and other current-consuming devices, means for moving the displayed objects relative to the observers, means for maintaining the area for the displayed objects -at an optimum temperature, means for evacuating spent air from the area for displayed objects and/or others.

A further object of the invention is to provide novel and improved means for facilitating access to the displayed objects by authorized persons.

Another object of the invention is to provide a display booth wherein the area or areas for displayed objects can be sealed from the surrounding atmosphere in a number of simple and efficient ways.

A further object of the invention is to provide the display booth with novel and improved means for collecting and evacuating liquids which can accumulate in the area or areas for displayed objects, e.g., as a result of melting of ice which is used to preserve perishable goods.

An additional object of the invention is to provide the display booth with a novel and improved support for the displayed objects and with novel and improved means for facilitating the display of larger or smaller numbers of objects in a relatively small area and in an eye-pleasing manner.

Another object of the invention is to provide a novel improved method of regulating access to the displayed goods by authorized persons and of preventing access to the displayed goods by unauthorized persons.

A further object of the invention is to provide a display booth which can be readily dismantled for longer-lasting storage or reassembled and wherein all parts which necessitate frequent inspection or replacement are immediately accessible to those who are authorized to carry out the inspection and/or repair work.

The invention is embodied in a display booth which comprises a support and an at least partially light-transmitting dome above the support. The dome is movable with reference to the support up and down between a plurality of different positions and the improved booth further comprises means for locating the dome in at least one of the plurality of different positions, particularly in its upper and lower end positions.

The dome defines a preferably semispherical or similar internal space, and the locating means preferably comprises a substantially upright elongated carrier for the dome. AT least a portion of the carrier is located in the internal space of the dome and the carrier is movable up and down with the dome. The support can include a substantially upright tubular guide which extends into the internal space of the dome and reciprocably receives the aforementioned portion of the carrier. The guide, the carrier and the dome preferably have a common substantially vertical axis.

At least one shelf can be provided in the internal space of the dome adjacent the tubular guide so that it can support one or more objects which are to be displayed to the public. Each shelf can have a substantially horizontal upper side and, in accordance with one embodiment of the invention, can be supported directly by the tubular guide for the carrier of the means for locating the dome.

The carrier is preferably provided with a relatively small substantially horizontal platform which carries the top portion of the dome. The platform and the top portion of the dome can define a clearance for a filler of plastic material or the like, e.g., a filler which comprises a plurality of synthetic plastic components. A cap can be provided to overlie the top portion of the dome, and such cap can have a substantially concave underside which is spaced apart from the top portion of the dome so that the latter is contacted only by the marginal portion of the cap. The platform can include a sleeve which extends from its underside and receives the upper end portion of the carrier. A second platform can be mounted on the upper end portion of the tubular guide beneath the platform of the carrier so that the platform of the carrier rests on the second platform, and the second platform has an opening for the carrier.

The display booth can further comprise one or more reflectors or other suitable means for illuminating the internal space of the dome, and means of supplying electrical energy to the reflector or reflectors. The energy supplying means can comprise at least one conductor extending into the internal space of the dome, preferably in substantial parallelism with the carrier. Each conductor can include a vertical rail which is mounted on the support.

The upper end portion of the carrier can be provided with a vertically extending tapped blind bore, and the display booth can further comprise a bolt, a screw or another threaded fastener having a head overlying the cap above the top portion of the dome and an externally threaded shank which extends through openings provided therefor in the cap, in the top portion of the dome and in the platform of the carrier and into the tapped bore in the upper end portion of the carrier. A friction or antifriction bearing can be interposed between the peripheral surface of the carrier and the internal surface of the tubular guide to hold the carrier against radial stray movements but to enable the carrier to move up and down relative to the guide.

The support preferably comprises a substantially horizontal table which is disposed beneath the dome and on which the dome comes to rest in one of its positions, namely in the lower end position. In accordance with a presently preferred embodiment of the invention, the table comprises a median panel, a top panel above the median panel and a bottom panel beneath the median panel. The panels can be provided with centrally located openings for the carrier of the means for locating the dome. Fastener means can be provided to secure the median panel of the table to the bottom panel.

The improved display booth preferably further comprises means for moving the dome up and down with reference to the support and its table, and such moving means can include a reversible electric motor or another suitable prime mover which is preferable installed in the interior of the support. For example, the display booth can be furnished with means for mounting the prime mover on one of the panels, particularly on the median panel of the table. Such mounting means can include at least one wall which extends from the one panel substantially vertically downwardly and carries the prime mover. The prime mover (such as the aforementioned reversible electric motor) can be designed to raise or lower the dome by way of the carrier, for example, through the medium of a feed screw which meshes with a nut in the carrier and is rotatable clockwise or counterclockwise, depending upon the direction of rotation of the motor. Alternatively, the prime mover can rotate a pinion having a substantially horizontal axis and mating with a vertical toothed rack which is directly or indirectly connected to the lower end portion of the carrier. The toothed rack can constitute an integral extension of the carrier.

The aforementioned tubular guide can be indirectly coupled to a panel of the table by a platelike bearing member on the lower end portion of the guide and a preferably hollow tubular pedestal which is installed between the one panel and the bearing member. Fastener means can be provided to secure the pedestal to the bearing member and to the one panel.

As mentioned above, the internal space of the dome can accommodate one or more shelves or analogous devices for supporting the displayed object or objects. Such shelf or shelves can be directly or directly secured to the tubular guide of the support. Alternatively, the shelf or shelves can be separably coupled to the aforementioned conductor or conductors in the internal space of the dome. If the conductor or conductors comprise one or more relatively sturdy vertical rails, the coupling means can include means for clamping the shelf or shelves to one or more rails of the conductor means. The arrangement may be such that the shelf or shelves can be secured to a single conductor or to two or more conductors. Analogously, the means for illuminating the internal space of the dome and the displayed objects can be clampingly and adjustably secured to a single rail or to two or more rails.

The support of the improved display booth further includes an understructure which carries the table and preferably defines one or more internal compartments. Such understructure can include a substantially upright hollow cylindrical wall serving to support a table which may but need not always have a circular outline.

The display booth can further include means for cooling the internal space of the dome, and such cooling means can include one or more cooling (e.g., refrigerating) apparatus installed in the internal compartment of the support. A suitable cooling apparatus can include a spiral or an otherwise configurated cooling element in or on or beneath the table. The table can include or can carry a vessel having an open top which faces the internal space of the dome. The central portion of the vessel can be provided with an upwardly extending collar which surrounds the adjacent portion of the tubular guide for the carrier of the means for locating the dome. The bottom wall can constitute the aforementioned top panel of the table. The aforementioned helical or otherwise configurated cooling element or elements of the cooling apparatus can be installed in or adjacent the vessel. If desired, a layer of heat insulating material can be installed between the bottom wall of the vessel and the remaining panel or panels of the table. In order to prevent the accumulation of excessive quantities of liquid (e.g., molten ice) in the vessel, the latter is preferably provided with one or more outlets and the support can confine one or more receptacles which receive liquid from the outlet or outlets of the vessel, e.g., by gravity flow or by employing one or more pumps.

The cooling apparatus can include an air cooler, and the table of the support can be provided with suitably distributed ports and/or otherwise configurated or dimensioned apertures which receive cooled air from the cooling apparatus by way of one or more conduits or other suitable conveying means and allowing the supplied cool air to penetrate into the internal space of the dome so as to ensure longer shelf life of perishable goods which cannot stand elevated temperatures. Means can be provided for evacuating stale air from the internal space of the dome, e.g., by way of one or more orifices or in the table.

A control panel can be mounted on or in the support to allow for regulation of the flow of current to one or more current-consuming devices of the improved display booth, such as the aforementioned reflector or reflectors, the prime mover means for moving the dome up and down, the cooling apparatus and/or a motor or other suitable means for rotating the table and the dome about a substantially vertical axis so that an interested viewer standing in front of a portion of the booth can see all of the displayed objects within an interval of time which elapses while the table and the dome complete a full revolution. The control panel can include a key-operated master switch which must be closed by a key in order to allow for operation of the current-consuming device or devices.

The carrier is preferably separable from the top portion of the dome (e.g., by removing the aforementioned screw) and from the tubular guide of the support. The tubular guide can be separably mounted on the table. The table preferably includes a circular or otherwise configurated rim having an upwardly extending portion which is engaged by the marginal portion of the dome when the latter assumes its lower end position, and a downwardly extending second portion which can overlie the upper end portion of the aforementioned cylindrical wall of the understructure of the support.

The first portion of the rim can be provided with an inclined (particularly frustoconical) supporting surface for the marginal portion of the dome. The inclination of the supporting surface can be such that its upper portion is more distant from the central vertical axis of the dome (such axis preferably coincides with the axes of the tubular guide and the carrier) than its lower portion or vice versa. The marginal portion of the dome can be provided with an outwardly or inwardly extending flange which has a surface abutting the supporting surface of the first portion of the rim. The marginal portion of the dome can include a first section which is disposed above and abuts the first portion of the rim and an annular second section which surrounds the rim and slopes downwardly and inwardly toward the periphery of the rim. Annular sealing means can be interposed between the marginal portion of the dome and the rim of the table to seal the internal space of the dome from the surrounding area when the dome is caused or permitted to assume its lower end position. At least one handgrip portion can be provided on or close to the marginal portion of the dome to facilitate manual lifting of the dome, e.g., in the event of failure of the prime mover means or during a blackout.

The improved display booth can be provided with means (e.g., one or more limit switches) for automatically arresting the means for moving the dome when the latter assumes the one or the other end position. Thus, if the prime mover is or includes a reversible electric motor, a limit switch which arrests the motor in the lower end position of the dome can be installed between the motor and the carrier so that it is actuated by the carrier as soon as the dome descends to a level at which its marginal portion rests on the rim of the table or on the aforementioned annular sealing means. Alternatively, the arresting means can comprise an electronic switch having or cooperating with means for evaluating the quantity of electrical energy which is supplied to the motor of the moving means, and such evaluating means then arrests the motor in the upper and/or lower end position of the dome.

The means for connecting the prime mover with the dome can include a first portion (e.g., a vertical toothed rack which can be moved by the aforediscussed pinion on the output shaft of a reversible electric motor or the aforementioned feed screw), a second portion (such as the aforementioned carrier for the top portion of the dome) and an elastic coupling between the first and second portions. Such coupling can include one or more coil springs. The purpose of the connecting means is to reduce the likelihood of damage to the dome and/or to the table when the dome reaches its lower end position.

The aforementioned means for rotating the table and the dome about a vertical axis can include an electric motor or another suitable prime mover which is installed in the support, particularly in an internal compartment of the aforementioned understructure which carries the table.

The carrier can have an asymmetrical peripheral surface which is reciprocable in but need not be rotatable relative to the tubular guide. For example, the carrier can include a solid or hollow rod having a cylindrical peripheral surface which is provided with one or more flats.

The external surface of the support (especially of the understructure of the support) can be provided with one or more coats of lacquer, varnish, water-resistant paint and/or other material which prolongs the useful life and enhances the appearance of the support. At least a portion of the light-transmitting dome can be made of acrylic glass.

As mentioned above, the marginal portion of the dome can be provided with one or more handgrip portions to facilitate manual lifting of the dome in the absence of a prime mover or in the event of failure of the prime mover or of the means for supplying energy to the prime mover. The aforementioned means for locking the dome to the rim of the table can be provided on or in the region of the handgrip portion or portions of the dome.

In order to prevent leakage of liquid into the internal compartment or compartments of the support, the tubular guide for the carrier can be provided with an inverted cup-shaped lid which overlies at least a portion of the aforementioned collar constituting the central portion of the vessel on or of the table.

The internal compartment or compartments of the support for the dome are accessible by way of one or more pivotable or slidable doors. The understructure of the support can include one or more drawers which serve for storage of goods to be displayed or for storage of accessories.

The rim of the table can be provided with means for suspending decorative material on the support. For example, the rim can be provided with hooks or like parts to carry plates or boards with advertising material. Such advertising material can be assembled into a skirt surrounding the understructure of the support.

The prime mover of the means for moving the dome up and down can include a low-voltage electric motor, and such motor can be installed in or adjacent the tubular guide of the support.

If desired or necessary, the aforementioned control panel can be equipped with means for transmitting signals to the motor or motors in the support by remote control.

The novel features which are considered as characteristic of the invention are set forth in particular in the appended claims. The improved display booth itself, however, both as to its construction and the mode of moving its dome, together with additional features and advantages thereof, will be best understood upon perusal of the following detailed description of certain specific embodiments with reference to the accompanying drawing.

BRIEF DESCRIPTION OF THE DRAWING

FIG. 8 is a fragmentary diagrammatic central vertical sectional view of the table, of the marginal portion of the dome and of an annular sealing element which prevents the flow of air between the internal space of the dome and the surrounding atmosphere when the marginal portion of the dome is caused to rest on the rim of the table;

FIG. 9 is a central vertical sectional view of a shelf which can be used in the improved display booth;

FIG. 10 is a schematic horizontal sectional view of the carrier and of the tubular guide therefor, a supporting means for displayed objects being indicated by phantom lines;

FIG. 11 is a fragmentary central vertical sectional view of the table and of the adjacent marginal portion of the dome, further showing a device for releasably locking the marginal portion of the dome to the rim of the table;

FIG. 18 is a fragmentary central vertical sectional view of the display booth, showing the manner of mounting the lower end portions of rail-shaped electric conductors in the table of the support for a dome which is movable up and down by hand;

FIG. 19 is a diagrammatic elevational view of means for connecting the dome to the prime mover by way of an elastic coupling which includes a coil spring;

FIG. 24 is a fragmentary schematic central vertical sectional view of a display booth wherein the marginal portion of the dome is provided with handgrip portions and with one or more devices for releasably locking the dome to the rim of the table;

FIG. 25 is a fragmentary central vertical sectional view of a display booth constituting a modification of that which is shown in FIG. 24;

FIG. 26 is a fragmentary central vertical sectional view of a modification of the connecting means of FIGS. 19 and 20;

DESCRIPTION OF THE PREFERRED EMBODIMENTS

Figure 1:
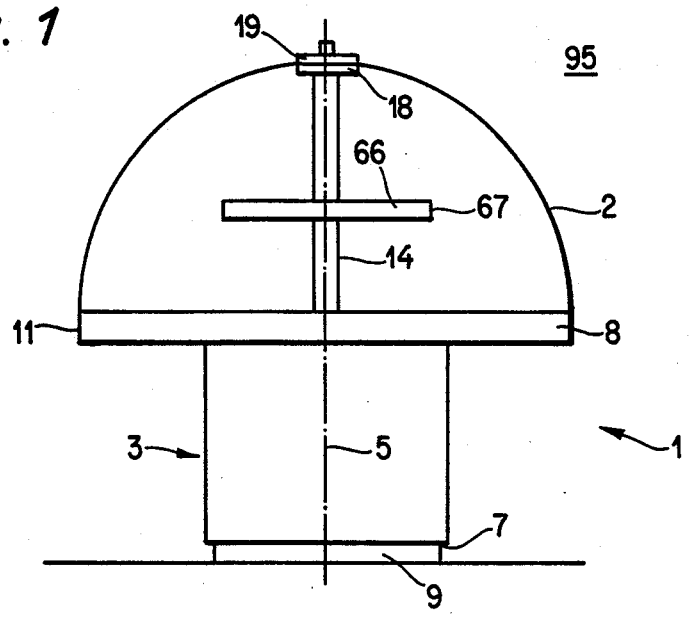
FIG. 1 is a schematic elevational view of a substantially mushroom shaped display booth which embodies one form of the invention, the light-transmitting dome being shown in its position of rest on the table of the support.
Figure 2:
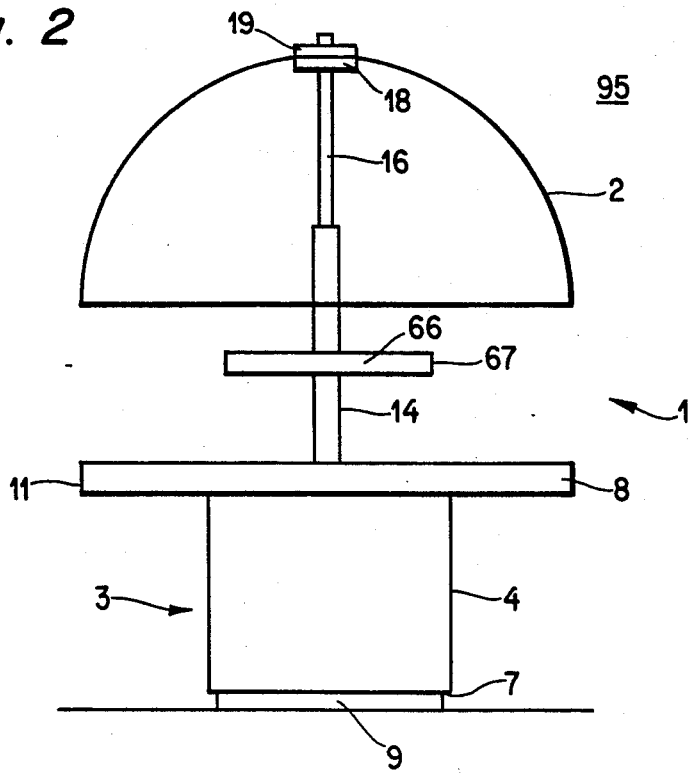
FIG. 2 shows the structure of FIG. 1 but with the dome in one of its raised positions so that it affords access to the upper side of the table as well as to a shelf on an upright tubular guide which forms part of the support and extends upwardly beyond the table.
Figure 3:
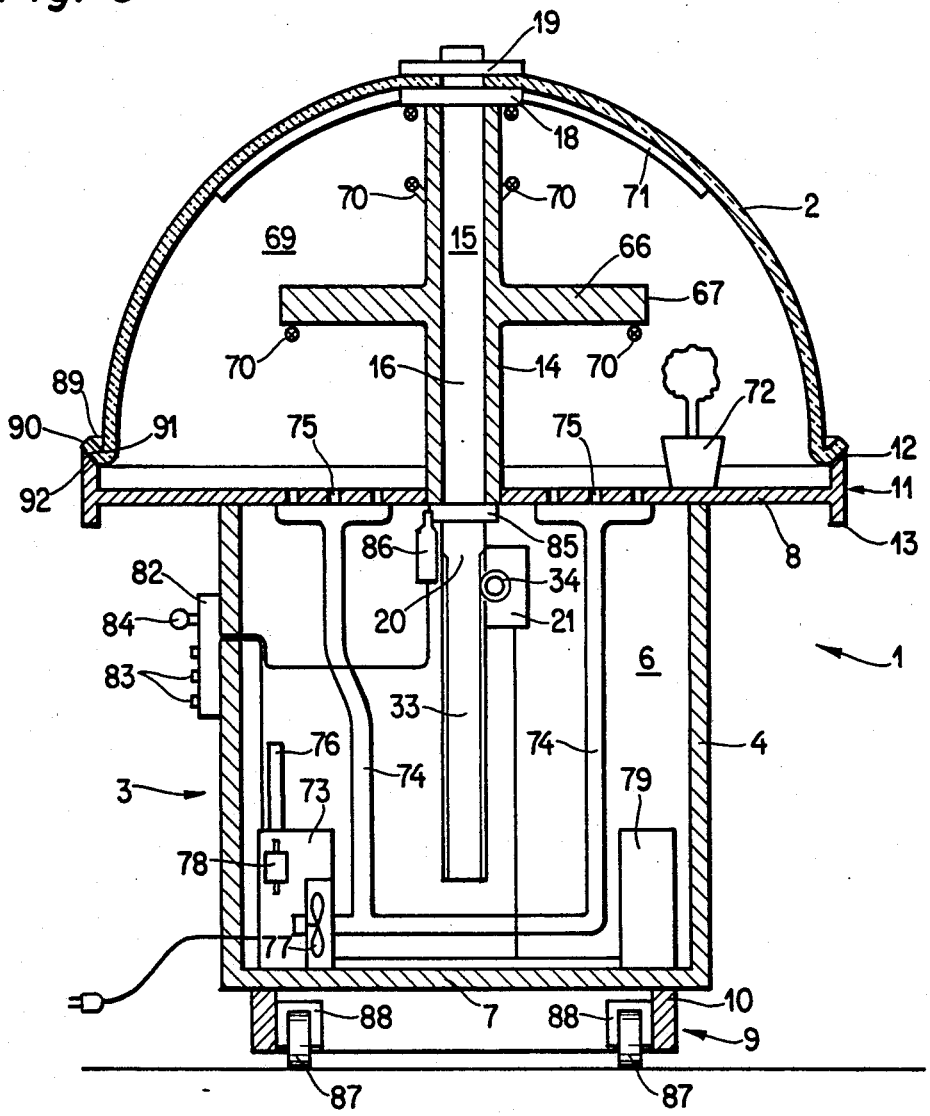
FIG. 3 is an enlarged central vertical sectional view of the display booth with the dome in the position of FIG. 1, further showing the means for rotating the table about a vertical axis, the apparatus for admitting cooled air into the internal space of the dome and one embodiment of the means for moving the dome and its carrier up and down.

The display booth 1 which is shown in FIGS. 1 to 3 comprises a support 3 and a substantially hemispherical dome or cupola 2 which is located at a level above the support 3 and is movable relative thereto between the lower end position of FIG. 1 and the upper end position of FIG. 2. At least a portion of the dome 2 consists of a light transmitting material, such as acrylic glass. It is not necessary that the dome 2 be exactly hemispherical, it can have a polygonal outline and its marginal portion can have a diameter which is less or more twice the height of the dome.

The support 3 includes a substantially horizontal circular table 8 which is mounted on top of an understructure 4 including a hollow cylindrical wall defining one or more internal compartments 6. The support 3 further includes a base portion 9 having a cylindrical skirt 10 extending downwardly from the bottom wall 7 of the understructure 4 and carrying several inverted U-shaped bearing members 88 for floor- or ground-contacting wheels 87. The bearing members 88 can constitute component parts of casters which allow for more convenient advancement of the entire booth 1 in any desired direction. In the embodiment of FIGS. 1–3, the outer diameter of the skirt 10 of the base 9 is somewhat smaller than the outer diameter of the understructure 4; however, it is equally possible to design the support 3 in such a way that the skirt 10 merely constitutes a downward extension of the understructure 4 below the bottom wall 7.

The illustrated table 8 has a substantially circular outline. However, it is equally possible to employ a table which has a polygonal or oval outline. The vertical axis 5 which is shown in FIG. 1 by a phantom line is common to the base portion 9, to the understructure 4 and to the table 8 of the support 3 as well as to the dome 2 of the display booth 1.

As shown in FIG. 3, the rim 11 of the table 8 has an upwardly extending first annular portion 12 which actually supports the marginal portion 89 of the dome 2 when the latter is caused or allowed to assume the lower end position of FIG. 1 or 3, and a downwardly extending second annular portion 13 which spacedly surrounds the upper portion of the cylindrical wall constituting the understructure 4 of the support 3. The upper portion 12 of the rim 11 has a frustoconical supporting surface 92 which slopes downwardly and inwardly toward the axis 5 and, in the lower end position of the dome 2, abuts a complementary frustoconical surface 91 on an outwardly extending flange 90 forming part of the marginal portion 89 of the dome.

Figure 16:
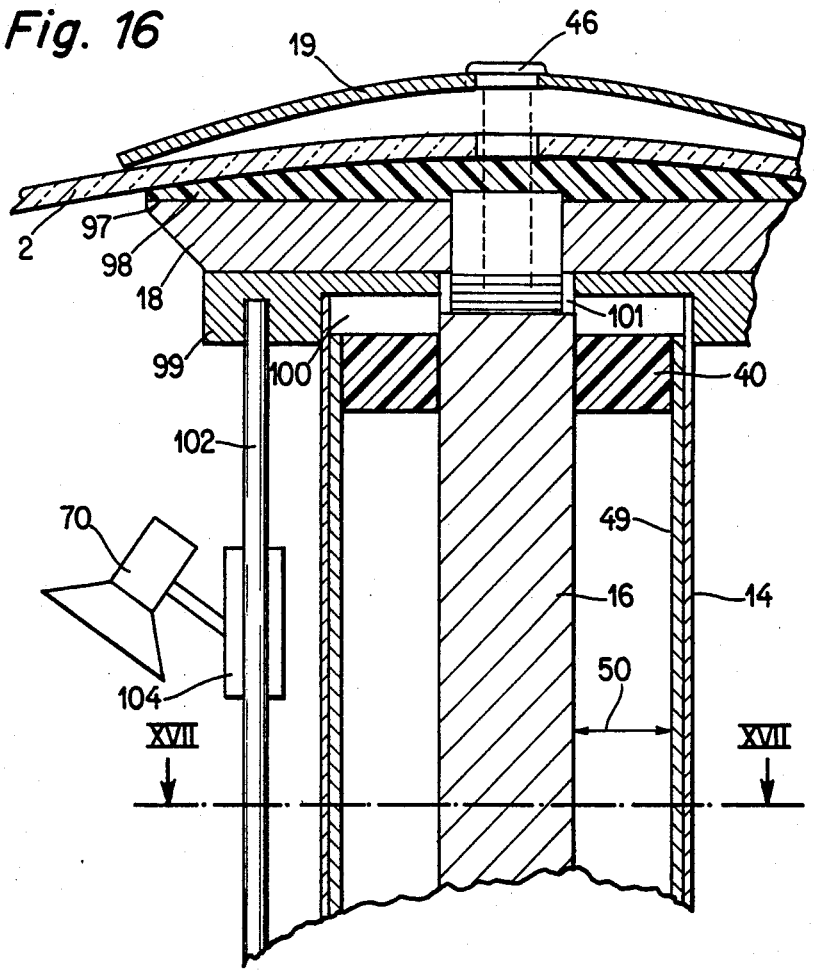
FIG. 16 is a view similar to that of FIG. 4 and further showing one presently preferred mode of mounting a reflector on an upright electrical conductor in the interior of the dome.
Figure 17:
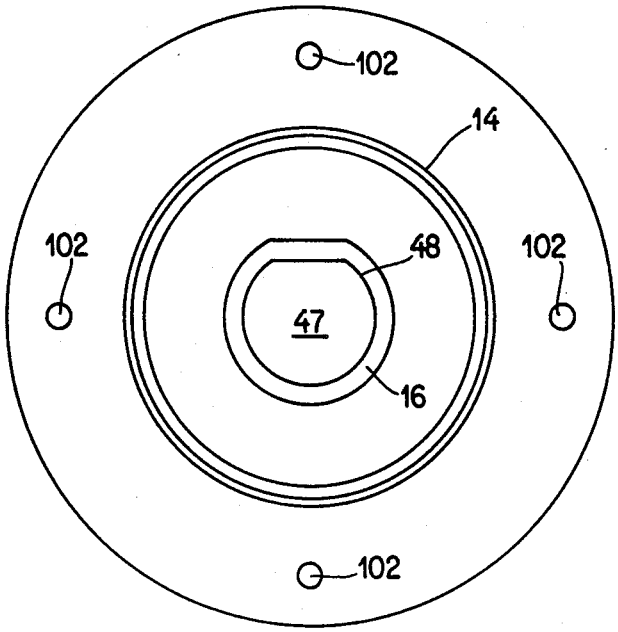
FIG. 17 is a horizontal sectional view substantially as seen in the direction of arrows from the line XVII—XVII of FIG. 16.

The support 3 further includes a hollow vertical tubular guide 14 which is rigidly but preferably separably connected to the central portion of the table 8 and extends into the internal space 69 of the dome 2. The guide 14 serves to limit a vertical carrier 16 to reciprocatory movements in its internal space 15. The upper end portion 17 (see FIG. 4) of the carrier 16 is indirectly connected with the top portion of the dome 2. To this end, the upper end portion 17 carries a horizontal platform 18 which has a circular outline and a marginal portion abutting the concave internal surface of the top portion of the dome 2. The platform 18 has a central opening 45 in register with a central opening 44 of the top portion of the dome 2 as well as with a central opening of a concavo-convex cap 19 which overlies the top portion of the dome in such a way that its concave internal surface is spaced apart from the adjacent portion of the convex external surface of the dome. The head 46 of a threaded fastener 42 overlies the cap 19 in the region of the opening 43, and an externally threaded shank of the fastener 42 extends through the openings 43, 44, 45 and into a tapped vertical blind bore 41 in the upper end portion 17 of the carrier 16. The cap 19 cooperates with the platform 18 to clamp the top portion of the dome 2 between them. As shown in FIG. 16, the platform 18 and the top portion of the dome 2 define a clearance 97 which surrounds the shank of the fastener 42 and contains a filler 98 which can be a multi-component hardened plastic material. A similar filler can be provided (if desired) in the space or clearance between the confronting surfaces of the top portion of the dome 2 and the cap 19. The filler 98 prevents direct or pronounced direct contact between the platform 18 and the dome 2.

Figure 4:
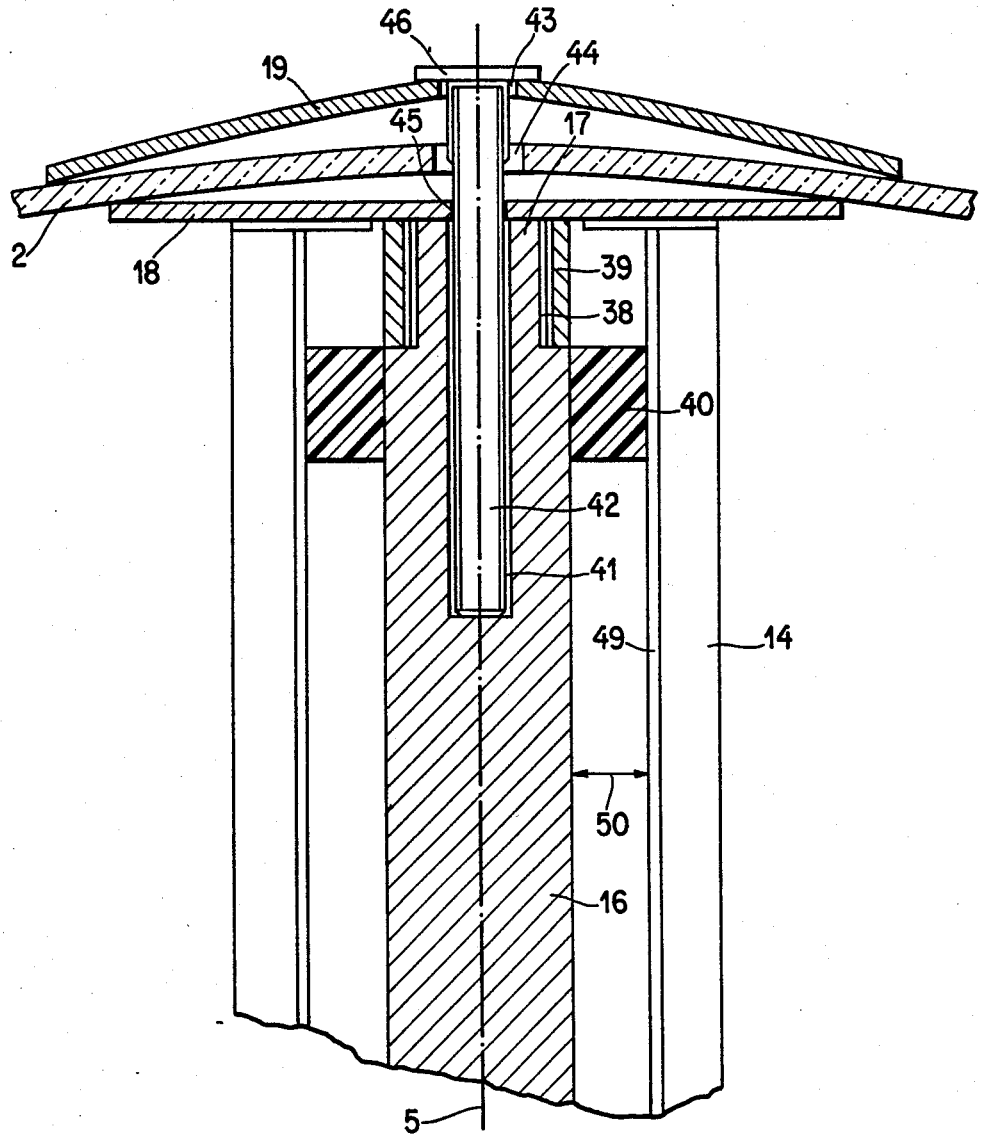
FIG. 4 is an enlarged view of a detail in the upper portion of FIG. 3, showing one of the presently preferred modes of separably connecting the dome to its carrier and of reciprocably mounting the carrier in the tubular guide of the support.

FIG. 16 further shows that, in contrast to the platform 18 of FIG. 4, the platform 18 beneath the filler 98 can have a frustoconical shape and can rest on a horizontal platform 99 which is secured to or is simply placed onto the upper end portion 100 of the tubular guide 14. The platform 99 has a central opening 101 for the carrier 16. The platform 18 of FIG. 16 rests on the platform 99 only when the dome 2 is caused or permitted to assume its lower end position in which its marginal portion 89 rests on the rim 11 of the table 8. The platform 99 can constitute a disc having a circular outline. This platform can further serve as a holder for the upper end portions of elongated vertical conductors 102 in the form of rather sturdy rails serving to supply electrical energy to one or more light sources 70, for example, in the form of floodlights which can be oriented to illuminate selected portions of the internal space 69 of the dome 2 and selected objects or goods which are displayed on the table 8 and/or on one or more shelves 66 which are directly or indirectly mounted on the tubular guide 14 or on the conductors 102. Each conductor 102 is or can be substantially parallel to the carrier 16 and to the guide 14. The conductors 102 can receive energy from a low-voltage source, such as a rechargeable battery 79 in the internal compartment 6 of the understructure 4 forming part of the support 3. The battery 79 is shown in the lower right-hand portion of FIG. 3 which further shows that a shelf 66 can be integral with the tubular guide 14 for the carrier 16. This carrier forms part of the means for locating the dome 2 in any one of its several positions relative to the table 8 of the support 3.

The means for moving the dome 2 up and down includes a reversible electric motor 21 which is installed in the internal compartment 6 of the support 3 and has an output shaft connected with a pinion 34 which is rotatable clockwise and counterclockwise about a substantially horizontal axis. The pinion 34 meshes with a vertical toothed rack 33 which is connected to or is integral with the lower end portion 20 of the carrier 16. The motor 21 is an a-c motor; however, it is equally possible to employ a d-c motor.

Figure 5:
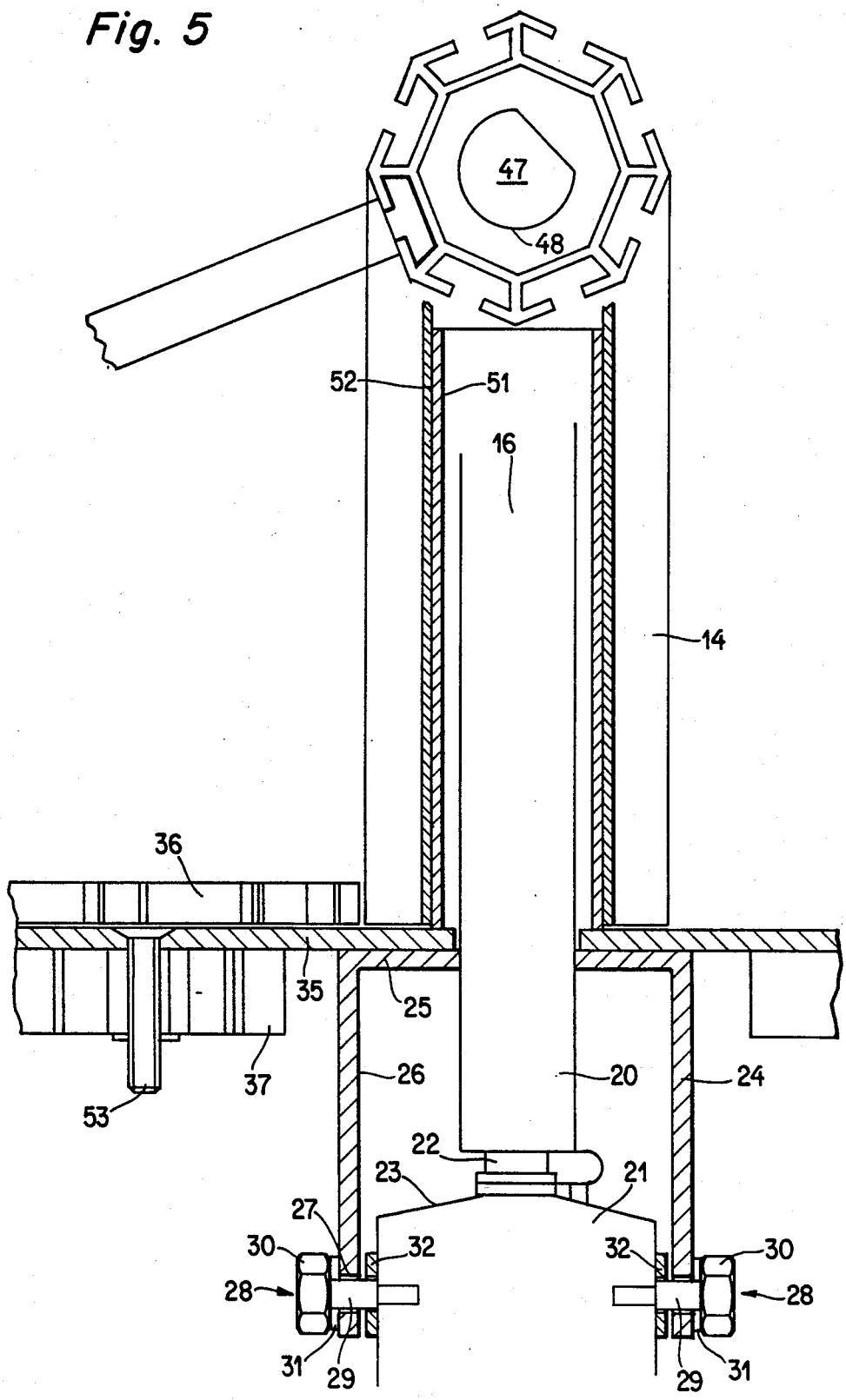
FIG. 5 is a fragmentary central vertical sectional view of a second display booth wherein the carrier for the dome is movable up and down by a modified prime mover, and further showing one of the presently preferred embodiments of the table, of the carrier and its tubular guide.

FIG. 5 shows a modified design of the means for moving the carrier 16 for the dome 2. The lower end portion 20 of the carrier 16 is provided with a nut (not specifically shown) in mesh with a feed screw 22 whose axis coincides with the axis of the carrier 16. The feed screw 22 is rotatable clockwise and counterclockwise by a reversible electric motor 21 which is mounted in a downwardly extending cylindrical wall 24 having a top wall 25 secured to a horizontal median panel 35 of the table 8. The body or housing 23 of the motor 21 is suspended in the cylindrical wall 24 by means of several horizontal bolts 28 each having a polygonal head 30 and a shank 29 extending through a hole 27 in the wall 24 and into a tapped bore of the housing 23. A washer 31 is installed between each head 30 and the external surface of the wall 24, and a distancing element 32 is installed between the housing 23 and the internal surface 26 of the wall 24 so as to surround the shank 29 of the respective bolt 28.

Figure 23:
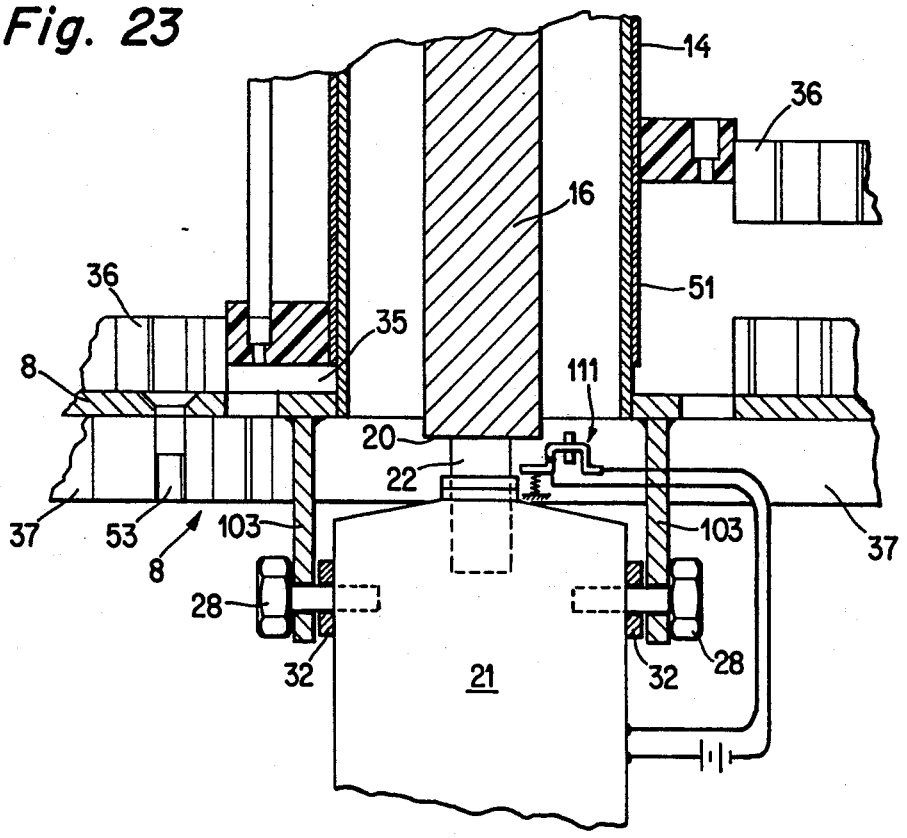
FIG. 23 is an enlarged fragmentary central vertical sectional view of a further display booth wherein a limit switch is installed between the carrier for the dome and the reversible electric motor of the means for moving the dome and the limit switch serves to arrest the dome in its lower end position.

FIG. 23 shows a somewhat modified mounting device for the electric motor 21 at the underside of the table 8. The main difference is that the cylindrical wall 103 which carries the bolts 28 for the housing of the motor 21 is welded directly to the panel 35 of the table 8 without the utilization of a top wall corresponding to the wall 25 in FIG. 5.

As shown in FIG. 19, the connection between the motor 21 and the dome (not shown in FIG. 19) can comprise a first portion 22 which can be constituted by the aforementioned feed screw, a second portion which is constituted by the carrier 16, and a third portion 112 which constitutes an elastic coupling in the form of a coil spring having its end convolutions interposed between the upper end face of the feed screw 22 and the lower end face of the carrier 16. The purpose of the coil spring 112 is to relieve the dome 2 of deforming stresses.

Figure 20:
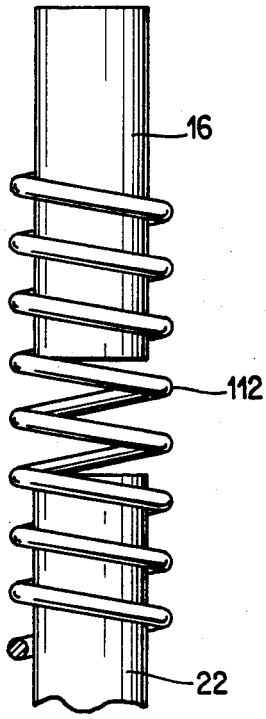
FIG. 20 is a schematic elevational view of modified connecting means wherein the end portions of the coil spring surround the adjacent ends of first and second rigid portions of the connecting means.

FIG. 20 shows that the coil spring 112 can be mounted in such a way that its end convolutions surround the lower end portion of the carrier 16 and the upper end portion of the feed screw 22.

A third embodiment of the elastically yieldable connecting means between the motor and the dome is shown in FIG. 26. The first or lowermost portion of the connecting means is a member 22 which can be moved up and down by a toothed rack, such as the rack 33 of FIG. 3, a second portion is in the form of a carrier 16 which is telescoped into an open socket of the member 22, and the third portion is a coil spring 112 having a lower end portion hooked to the surface at the bottom of the socket of the member 22 and an upper end portion received in a socket extending upwardly from the lower end face of the carrier 16.

FIG. 19 shows a limit switch 111 which is in circuit with the reversible motor 21 and serves as a means for arresting the motor 21 in the lower end position of the dome 2. The movable portion of the limit switch 111 is engaged by the lower end portion of the feed screw 22 when the latter reaches an axial position corresponding to the lower end position of the dome 2 and carrier 16. A similar limit switch 111 is shown in FIG. 23. This limit switch is installed in the path of downward movement of the lower end portion 20 of the carrier 16 which has an internal nut mating with the rotary feed screw 22 of the motor 21. When the carrier 16 reaches its lower end position (in which the marginal portion 89 of the dome 2 comes to rest on the rim 11 of the table 8), its lower end portion 20 actuates the limit switch 111 so that the circuit of the motor 21 is automatically opened in the lower end position of the dome.

It is also within the scope of the invention to replace the illustrated limit switches 111 with an electronic switch which includes or is combined with means for evaluating the current that is supplied to the motor 21 and for automatically arresting the motor when the quantity of consumed energy is indicative that the motor has encountered a certain resistance to further upward or downward movement of the dome 2.

Figure 6:
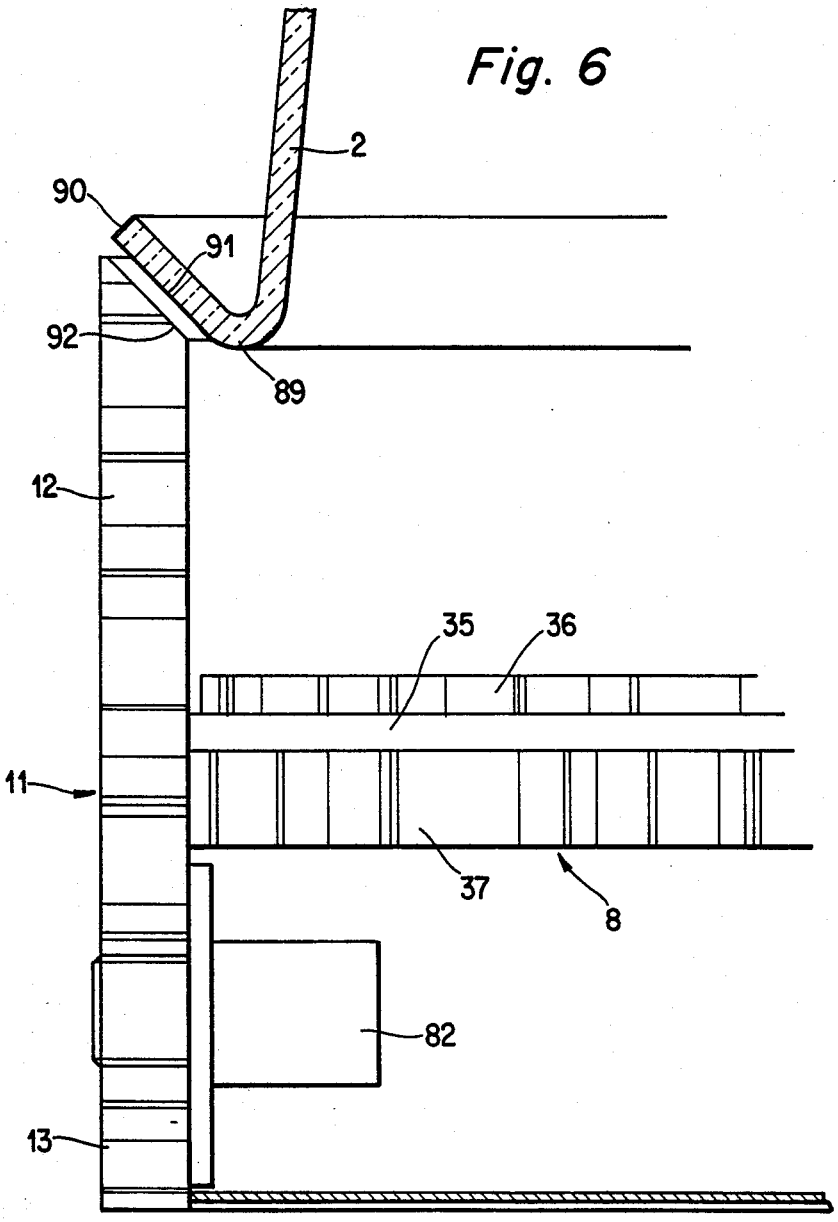
FIG. 6 is an enlarged vertical sectional view of a portion of the table and of one mode of designing its rim and the marginal portion of the dome.

As can be seen in FIGS. 5 and 6, the table 8 can comprise a median panel 35 which is disposed below a top panel 36 and overlies a bottom panel 37. The median panel 35 can be connected with the wall 24 or 103 of the means for mounting the motor 21 on the table 8. The panel 36 can enhance the appearance of the table 8 and can serve as a means for directly supporting one or more displayed objects 72 one of which is shown in FIG. 3 in the form of a flower pot. The median panel 35 is connected to. the bottom panel 37 by one or more fasteners 53 one of which is shown in FIG. 5.

It is not always necessary to assemble the table 8 of several panels. For example, and as shown in FIG. 3, the table 8 can constitute a single plate or panel having a substantially or exactly horizontal top surface which carries one or more displayed objects such as the aforementioned pot 72.

FIG. 4 shows that the platform 18 which carries the top portion of the dome 2 can be provided with a downwardly extending sleeve-like portion 39 which surrounds the smaller-diameter upper end portion 17 of the carrier 16. The reference character 38 denotes the peripheral surface of the upper end portion 17; such peripheral surface is surrounded by the internal surface of the sleeve 39. FIG. 4 further shows a friction bearing 40 which is installed in the upper portion of the tubular guide 14 and surrounds the carrier 16 so that the latter is free to move up and down but is held against lateral stray movements relative to the guide 14. This bearing ensures that the width 50 of the annular space between the internal surface 49 of the tubular guide 14 and the periphery of the main portion of the carrier 16 remains unchanged in each axial position of the dome 2 and carrier 16. If desired, the tubular guide 14 can confine two or more friction bearings 40 for the carrier 16. Furthermore, it is equally possible to replace the illustrated friction bearing 40 with one or more antifriction bearings or to use one or more antifriction bearings jointly with one or more friction bearings.

Referring to -FIG. 10, the carrier 16 can have a partly cylindrical peripheral surface 48 and an asymmetrical cross-section 47 because it is provided with a rather large flat. The internal surface 49 of the guide 14 (FIG. 4) is spaced apart from the peripheral surface 48 of the carrier 16 by the aforementioned distance 50 so that the components 16 and 14 are not in direct contact with each other.

As shown in FIG. 5, the tubular guide can include an outer wall 52 which is slipped onto an inner wall 51 having the aforementioned internal surface 49 and spacedly surrounding the carrier 16. The inner wall 51 is welded or otherwise secured to the median panel 35 of the table 8.

The fasteners 53 which are used to secure the median panel 35 of FIG. 5 to the bottom panel 37 can be replaced by other securing means, for example, by a suitable adhesive.

Figure 29:
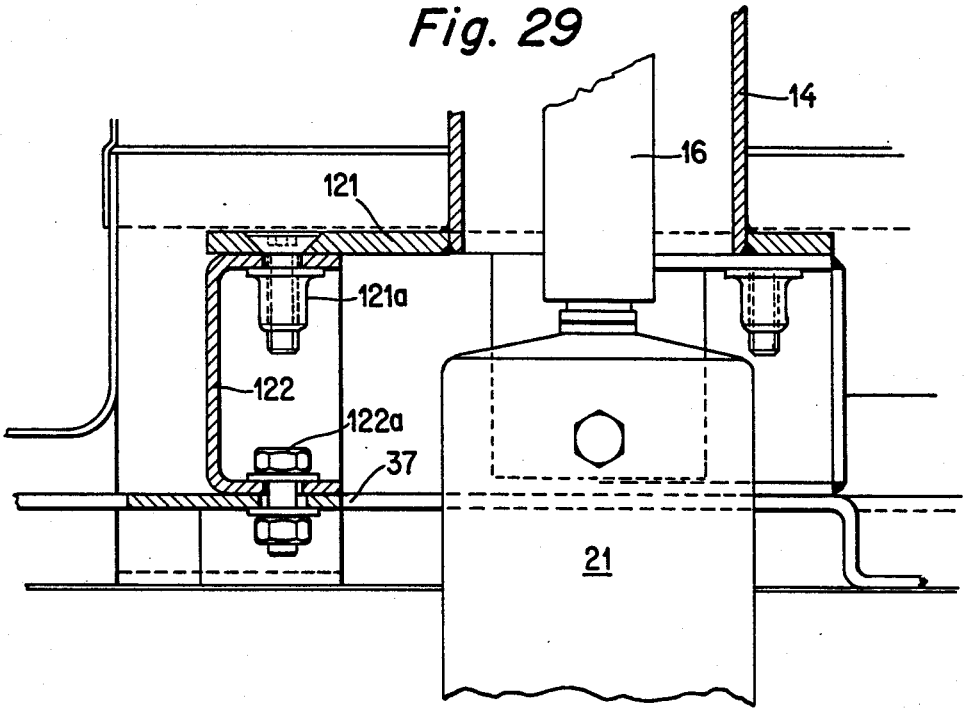
FIG. 29 is a fragmentary central vertical sectional view of a further display booth wherein the tubular guide for the carrier which moves the dome is mounted on the table by way of a hollow pedestal.

A different mode of securing the tubular guide 14 to the table 8 is shown in FIG. 29. The lower end portion of the guide 14 is welded to a substantially plate-like bearing member 121 which rests on top of a hollow pedestal 122. The pedestal 122 rests on the panel 37 of the table 8 and is secured thereto by fasteners **122*a***.

Additional fasteners 121a are employed to secure the bearing member 121 to the top portion of the pedestal 122. The motor 21 is connected to the carrier 16 of FIG. 29 by a feed screw in a manner as described in connection with FIG. 5.

Referring again to FIG. 10, the tubular guide 14 which is shown therein is equipped with means for supporting and guiding one or more supporting devices or arms 65 for displayed objects, particularly for shelves 66. One such supporting device is shown in the upper portion of FIG. 10. The tubular guide 14 of FIG. 10 is provided with vertical guide channels 54 which are flanked by radially extending walls 58 and bottom walls 56. The outer walls 60 of the tubular guide 14 have openings 62 for the necks 64 of the supporting devices 65. The head 63 of the illustrated supporting device is received in the selected portion 61 of the respective vertical channel 54. Each opening 62 is flanked by two aligned vertically extending portions of the respective outer wall 60 of the guide 14. The illustrated guide 14 has an octagonal cross-sectional outline with the radially extending walls 58 located at the corners 59 between neighboring facets of the external surface of the guide 14. The inner wall 55 of the guide 14 also resembles an octagon with eight vertically extending mutually inclined portions or narrower walls 56 constituting the bottom walls of the respective guide channels 54. The inner end portions of the radially extending walls 58 are integral with the corners 57 between the adjacent narrow sections 56 of the inner wall 55.

Two or more radially extending supporting devices in the form of arms 65 can carry a detachable shelf 66 of the type shown in FIG. 9. This shelf has a downwardly extending annular marginal portion 67 which extends beyond the respective supporting devices 65 and confines additional illuminating means 68 in the form of cold light sources. The heads 63 of the supporting devices 65 can be held in the respective channels 54 by friction, and such heads can be pushed up or down so as to change the level of the shelf 66 between the platform 18 and the table 8. The light sources 68 of FIG. 9 can illuminate from above the object or objects on the table 8. The light sources 70 which are shown in FIG. 3 can illuminate the objects in addition to the light sources 68. Furthermore, at least some of the light sources 70 which are shown in FIG. 3 can direct light against a reflector 71 in the form of a mirror having a concave internal surface corresponding to the concave internal surface of the dome 2 and serving to reflect light onto the object or objects resting on the shelf 66. The two lower light sources 70 of FIG. 2 are designed to direct light directly upon the object or objects on the upper side of the table 8.

Figure 21:
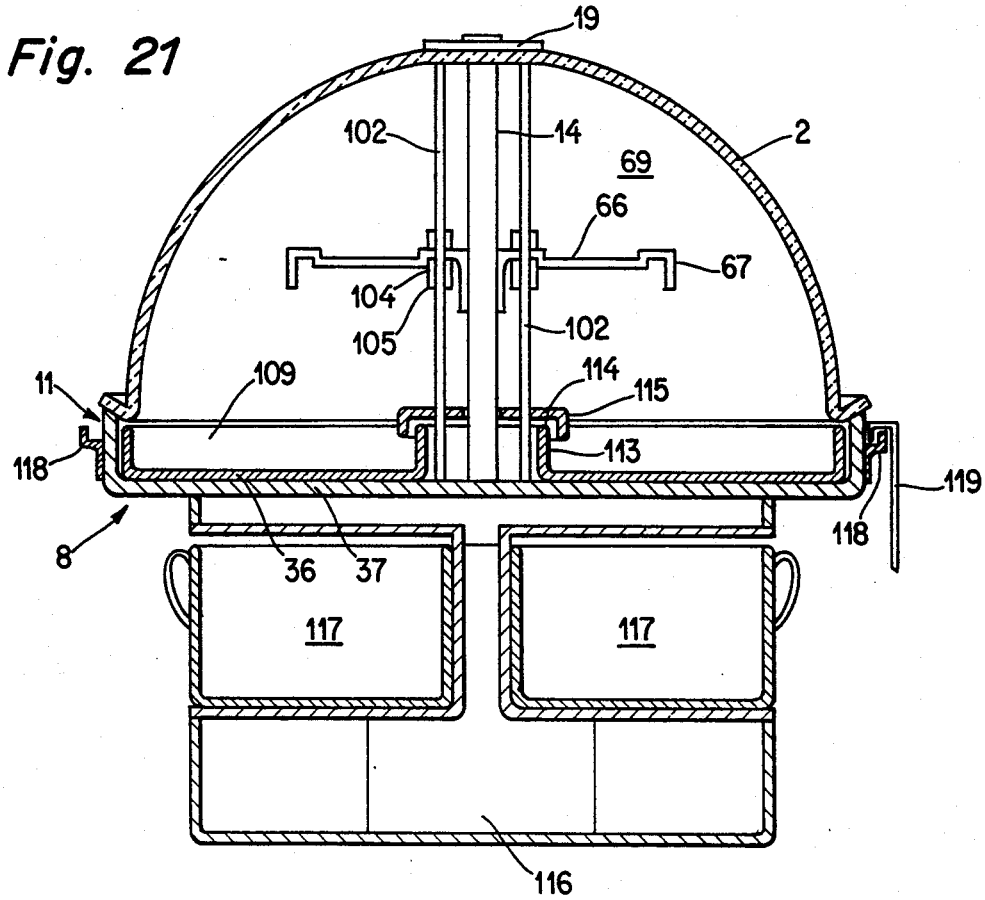
FIG. 21 is a somewhat schematic central vertical sectional view of a further display booth wherein the table of the support includes or carries a flat pan-shaped vessel for a liquid medium.

FIG. 21 shows that a shelf 66 can be mounted directly on the upright conductors 102 which supply energy to the light sources (not shown in FIG. 21). To this end, the conductors 102 are surrounded by clamps 104 constituting means for separably coupling the shelf 66 to the respective conductors 102. As mentioned above, the conductors 102 can constitute sturdy upright rails the upper end portions of which are secured to the tubular guide 14 or to the platform 99 on top of the guide. The clamps 104 can be provided with screws 105 or with other suitable retaining devices which fix them to the respective conductors 102. By loosening the screws 105, the person in charge can raise or lower the shelf 66 along the corresponding conductors 102 prior to reapplying the screws 105 so as to retain the shelf in the newly selected position at a desired level above the table 8. The mode of mounting the shelf 66 of FIG. 21 is simpler than the mode of mounting the shelf 66 of FIG. 9 because it is not necessary to provide two or more supporting arms 65 for each shelf.

Figure 7:
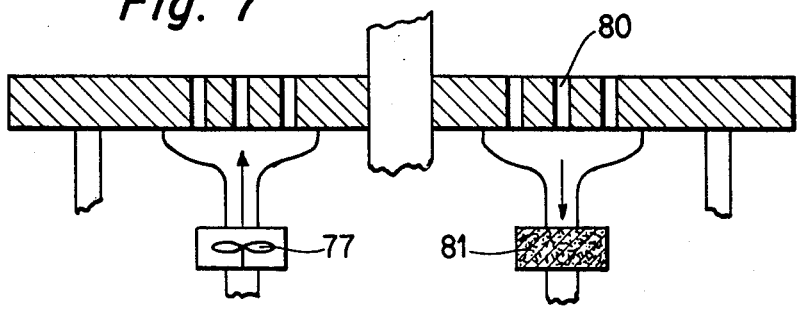
FIG. 7 shows a portion of a modified cooling apparatus and the means for evacuating heated air from the internal space of the dome.

FIG. 3 shows a cooling apparatus which is installed in the internal compartment 6 of the support 3 on the bottom wall 7 and includes a fan 77 which propels air into conduits 74 serving to convey cooled air to apertures 75 in the form of vertically extending ports provided in the table 8. Air which is propelled by the fan 77 is cooled in one or more heat exchangers 76, and the fan 77 is driven by an electric motor 78. Cooled air in the internal space 69 prolongs the life of certain types of objects, such as vegetables, flowers or foodstuffs. If desired, a discrete fan 77 can be mounted in each of the conduits 74 (see FIG. 7). FIG. 7 further shows vertical ports 80 which are provided in the table 8 and serve for evacuation of stale air from the internal space 69 of the dome. Such stale air must pass through one or more filters 81 before it is discharged into the surrounding area 95 or conveyed back to the cooling apparatus 73.

The apertures or ports 75 which are shown in the table 8 of FIG. 3 can be replaced with orifices or nozzles which disperse the admitted cool air into each and every portion of the internal space 69 of the dome 2. This ensures more uniform distribution of cool air beneath the dome. The motor or motors 78 of the cooling apparatus 73 are a-c motors which drive the fan or fans 77 and can also operate the heat exchanger or heat exchangers 76. Such a-c motors can be replaced with d-c motors without departing from the spirit of the invention. The d-c motors can receive electrical energy from the battery 79 which is installed in the internal compartment 6 of the support 3. This is preferably a rechargeable battery or an entire set or group of rechargeable batteries.

If desired, the ports or apertures 75 in the table 8 can be omitted; cool air is then admitted into the interior of the tubular guide 14 which must be provided with one or more ports for admission of cool air into the internal space 69 of the dome 2.

The cooling apparatus 73 can be connected with suitable temperature indicating means which can be installed on the hollow cylindrical wall of the understructure 4 so that such instrument can be readily observed by the person in charge of attending to the display booth 1. For example, such instrument can be installed on or in the region of a control panel 82 which is mounted at the exterior of the understructure 4 and includes a key-operated master switch 84 as well as a number of pushbuttons 83 which can be operated by the attendant to start or arrest the motor or motors 78, the motor 21 or a further motor 86 cooperating with a gear 85 on the table 8 to rotate the table at a predetermined speed, for example, at a constant speed or at certain intervals. This renders it possible for a person standing adjacent the display booth 1 to observe all of the displayed objects on the table 8 and/or on the shelf or shelves 66 during a certain interval of time which elapses while the table 8 completes a full revolution. The control panel 82 can further comprise means for indicating the temperature in the internal space 69 of the dome 2.

If more convenient, the control panel 82 can be mounted on the rim 11 of the table 8 as long as it does not interfere with up- and down-movements of the dome 2.

In order to reduce friction when the table 8 rotates, its bottom panel can be fixedly mounted in the understructure 4 and its upper two panels 35, 36 can be provided with wheels (one shown at 120 in FIG. 22) so as to ensure that a relatively, small motor 86 can rotate the table 8 and the dome 2 about the vertical axis 5.

As can be seen in FIGS. 3 and 6, the marginal portion 89 of the dome 2 can be provided with an outwardly and upwardly sloping flange 90 having a complementary surface 91 which abuts the supporting surface 92 of the upwardly extending portion 12 of rim 11 forming part of the table 8. Such configuration of the marginal portion 89 and rim portion 12 ensures automatic centering of the dome 2 when the latter is permitted or caused to assume its lower end position and comes to rest on the rim 11.

Figure 12:
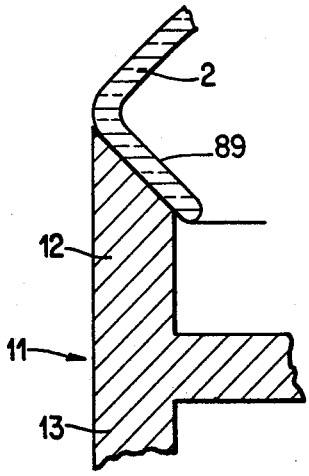
FIG. 12 is a fragmentary central vertical sectional view of the table and of a portion of a dome having a modified marginal portion with an inwardly extending flange.

FIG. 12 shows that the flange of the marginal portion 89 of the dome 2 can slope inwardly and downwardly so that it overlies the supporting surface of the upper portion 12 of the rim 11 substantially in the same way as shown in FIG. 3, namely the centering action is just as satisfactory as in the embodiment of FIG. 3.

Figure 13:
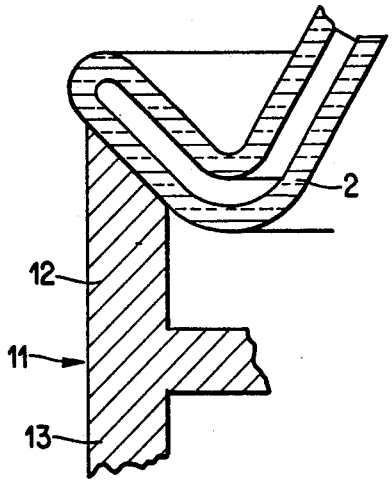
FIG. 13 is a view similar to that of FIG. 12 but showing a twin-walled marginal portion of the dome and a modified rim of the table.

FIG. 13 shows a twin walled dome 2 having a marginal portion which is similar to that shown at 89 in FIG. 3.

Figure 14:
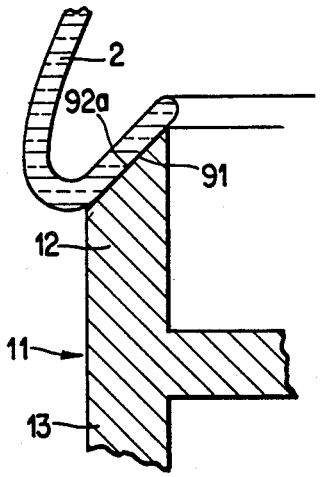
FIG. 14 is a view similar to that of FIG. 12 but showing a different marginal portion of the dome and a modified rim of the table which supports the marginal portion when the dome assumes its lower end position.

FIG. 14 shows that the dome 2 can have a marginal portion 89 with a flange which slopes upwardly and inwardly so that its surface 91 resembles a conical frustum which tapers downwardly and outwardly and is complementary to the supporting surface 92*a* on the upwardly extending portion 12 of the rim 11.

Figure 15:
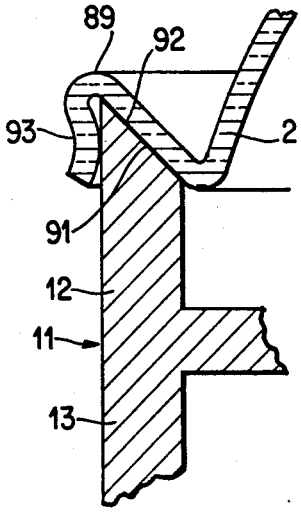
FIG. 15 is a view similar to that of FIG. 12 but showing still another rim and a modified marginal portion of the dome.

FIG. 15 shows a further modification according to which the annular marginal portion 89 of the dome 2 has a first section which is provided with the complementary surface 91 abutting the supporting surface 92 of the upwardly extending portion 12 of the rim 11, and a tubular second section 93 which surrounds the portion 12 and tapers inwardly and downwardly, preferably into actual contact with the periphery of the rim 11. The structures which are shown in FIGS. 13, 14 and 15 also ensure predictable centering of the dome 2 on the rim 11 of the table 8.

FIG. 11 shows a locking device 94 which can be provided between the marginal portion 89 of the dome 2 and the upwardly extending portion 12 of the rim 11. Such locking device is especially desirable when the dome 2 is to remain in its lower end position for longer periods of time or when the locking action of the prime mover 21 does not suffice to reliably hold the dome in its lower end position. Still further, such locking device or devices 94 will or can be employed when the dome is to be raised and lowered by hand.

The advantages of properly centering the dome 2 on the table 8 will be appreciated by looking at FIG. 8 which shows an annular sealing device 96 interposed between the outwardly extending marginal portion 89 and the upwardly extending portion 12. Thus, a single ring-shaped seal 96 suffices to adequately seal the internal space 69 of the dome 2 from the surrounding area 95 so as to reduce the likelihood of spoilage of confined goods and/or penetration of foul odors (if any) from the internal space 69 into the surrounding area 95.

Referring to FIG. 24, there is shown a portion of a display booth with a dome 2 which has at least two handgrip portions 110 forming integral parts of its marginal portion and serving to facilitate manual lifting and lowering of the dome relative to the support 3. At least two locking devices 94 can be provided to secure the marginal portion of the dome 2 (for example, the handgrip portions 110) to the rim 11 of the table 8.

FIG. 25 shows a substantially S-shaped handgrip portion 123 which overlaps and is preferably rigid with the marginal portion 89 of the dome and is releasably secured to the rim of the table by a locking device 94. The handgrip portion 123 of FIG. 5 can form part of an annular member which overlaps the entire marginal portion 89 and surrounds the periphery of the rim 11.

At least the major part of the understructure 4 of the support 3 forming part of the improved display booth 1 can be made of plywood the outer side of which is preferably provided with a coat of lacquer so as to enhance its appearance and to prolong it useful life. The lacquer can be burned onto the external surface of the understructure 4. It is also possible to employ other types of coating material, for example, one or more layers of polyurethane lacquer. It is further possible to make at least a portion of the support 3 of a metallic material, such as sheet aluminum or sheet steel, or to employ combinations of two or more different materials. All that counts is to ensure that the support 3 is sufficiently sturdy and can stand the climatic conditions in the area of actual use. Furthermore, the coat or coats can be applied solely or primarily to enhance the appearance of the display booth 1. The shelf or shelves 66 as well as the tubular guide 14 can be made of aluminum. However, it is also possible to make such parts of a suitable plastic material or of sheet steel.

Figure 22:
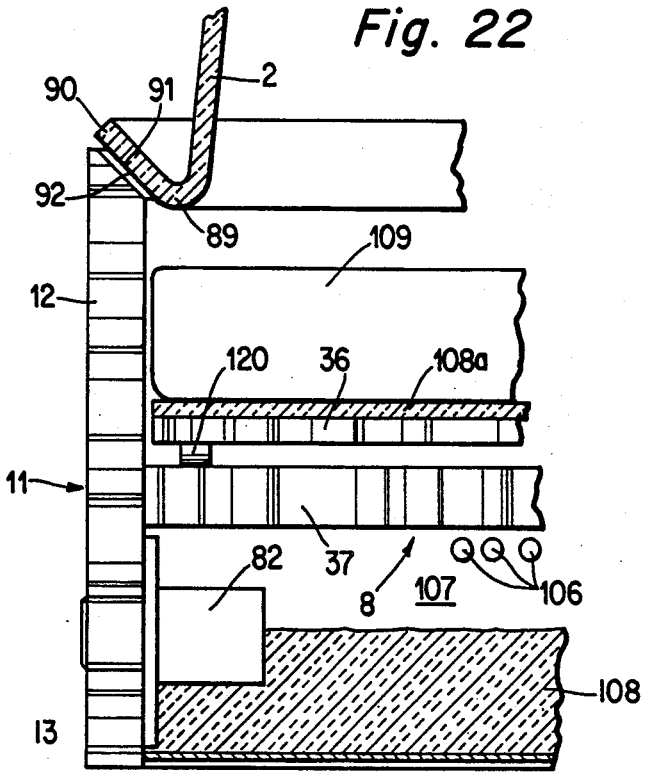
FIG. 22 is a fragmentary central vertical sectional view of a display booth which constitutes a modification of the display booth of FIG. 21 and wherein the vessel is mounted on a layer of heatinsulating material on top of the table.

FIG. 22 shows that the downwardly extending portion 13 of the rim 11 of the table 8 surrounds a layer of heat insulating material 108 which insulates the internal compartment 6 of the understructure 4 from the surrounding area 95. The layer 108 is disposed between the bottom panel 37 of the table 8 and a sheet metal support for the layer 108 and defines with the bottom panel 37 a space 107 which can confine a helical or otherwise configurated cooling element 106 forming part of the cooling apparatus 73 or another suitable cooling apparatus for the contents of a pan-shaped open-top vessel 109 on top of the panel 36. A second heat insulating layer 108*a* can be placed between the bottom wall of the vessel 109 and the panel 36. As shown in FIG. 21, the vessel 109 can be provided with an upwardly extending centrally located collar 113 which surrounds the adjacent portion of the tubular guide 14. The guide 14 carries an inverted cup-shaped lid 115 which can come to rest on the upper end face 114 of the collar 113 to prevent penetration of liquids from the interior of the vessel 109 into the internal compartment 6 of the support 3.

The vessel 109 can serve for storage of ice which is used to preserve certain perishable foodstuffs. Molten ice can be discharged from the vessel 109 by way of one or more outlets 126 (see FIG. 27) having lower end portions 127 arranged to discharge the liquids into a collecting receptacle 128 in the interior of the support 3. The illustrated outlet 126 can be disposed directly above the open top of the receptacle 128 so that the liquid can descend by gravity. However, it is also possible to employ a continuously or intermittently operated pump which conveys the liquid contents of the vessel 109 into the receptacle 128.

Figure 27:
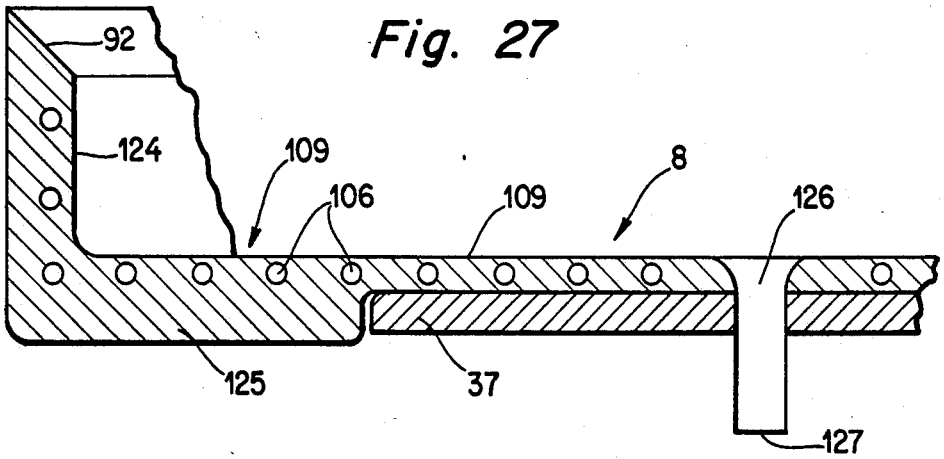
FIG. 27 is a fragmentary central vertical sectional view of a modified table with an integral open-top vessel having an outlet for the collected liquid and further showing a receptacle which can receive liquid from the outlet.
Figure 27:
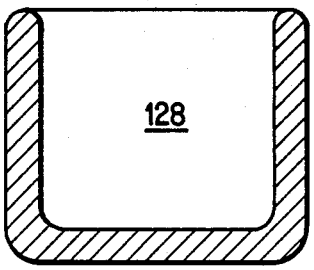

FIG. 27 further shows that the vessel 109 can constitute an integral part of the table 8. Thus, the bottom wall of the vessel 109 can constitute the topmost panel of the table 8. This vessel has an upwardly extending cylindrical marginal portion 124. As shown in FIG. 27, the aforementioned cooling element in the form of one or more coils 106 can be installed in the bottom wall and in the outwardly extending cylindrical marginal portion 124 of the vessel instead of being located in the space 107 beneath the table 8 as shown in FIG. 22. The marginal portion 124 which is shown in FIG. 27 can be said to constitute a rim corresponding to the rim 11 of FIG. 3 and has a frustoconical supporting surface 92 which centers the dome when the latter assumes its lower end position.

Referring again to FIG. 21, the support of the improved booth can be provided with one or more doors 116 (which can be slidable or pivotable) serving to afford access to the internal compartment of the understructure of the support. Furthermore, such understructure can be provided with one or more reciprocable drawers 117 having handles to facilitate their shifting between extended and confined positions. The drawers 117 can be locked to the understructure and can serve to confine objects to be exhibited and/or the accessories of the improved booth. Still further, FIG. 21 shows that the rim 11 of the table 8 can be provided with means 118 for suspending decorative material 119. For example, the decorative material 119 can constitute panels of advertising matter, and such panels can form a partial or a circumferentially complete skirt around the understructure of the support. Each of the suspending devices 118 can constitute a suitably configurated (for example Z-shaped) hook or bracket which is welded or otherwise secured to the rim 11 of the table 8. In this embodiment of the improved booth, the marginal portion of the open-top vessel 109 is located inwardly of the rim 11 of the table 8. It is also possible to simply paste the upper portions of panels of decorative material 119 to the marginal portion 11 of the table 8. Other types of suspending means (for example, pushbutton-actuated devices) can be employed in lieu of the hooks 118 with similar or equal advantage.

The wheels 87 which are shown in FIG. 3 facilitate convenient transport of the entire booth 1 to or from a selected location. The dome 2 can be completely lifted off the tubular guide 14 so as to allow for installation of one or more additional shelves 66 or for removal of one or more shelves, depending on the nature and number of displayed objects.

The motor 21 not only serves as a means for moving the dome 2 up and down but it can also serve as the primary or auxiliary locking device which replaces or assists the locking devices of the type shown at 94 in FIG. 11 in order to ensure that the dome 2 is reliably held in its lower end position so that unauthorized persons cannot gain access to the objects which are exhibited on the table 8 and/or on one or more shelves 66.

When the dome 2 is held and locked in the lower end position, such as the position shown in FIG. 3, the limit switch 111 opens the circuit of the motor 21 so that, if an operator wishes to lift the dome 2, it is necessary to depress one of the pushbuttons 83 on the control panel 82. Such pushbutton actuates a switch which is connected in parallel with the limit switch 111 and completes the circuit of the motor 21 so that the latter can lift the dome 2, either by way of the rack 33 and pinion 34 of FIG. 3 or by way of the feed screw 22 of FIG. 5. The limit switch 111 is closed as soon as the dome 2 leaves its lower end position so that the parallel-connected switch can be opened by terminating the application of pressure to the corresponding pushbutton 83 on the control panel 82. A further limit switch (not specifically shown) can be employed to arrest the motor 21 when the dome 2 is raised to its upper end position. Alternatively, the circuit of the motor 21 can comprise a time-delay device which automatically opens the circuit as soon as the output element of the motor has completed a preselected number of revolutions. As mentioned above, the circuit of the motor 21 can include an electronic switch which automatically monitors the quantity of energy that is supplied to the motor during different stages of movement of the dome 2 relative to the table 8 and serves to arrest the motor when the dome 2 reaches its upper or lower end position. Such types of electronic switches are available on the market. Thus, when the dome 2 comes to rest on the rim 11 of the table 8, the current consumption of the motor 21 increases considerably because the resistance to further rotation of the output element of the motor increases, and this is detected by the evaluating circuit of the electronic switch to generate a signal which opens the motor circuit. Such safety arrangement is desirable and advantageous because it reduces the likelihood of excessive deformation of the dome 2 and/or rim 11.

The provision of coupling device 112 is desirable and advantageous because such device reduces the likelihood of damage to the dome 2 and/or table 8. When the motor 21 is to lower the dome 2 to its position of rest on the rim 11, the coupling device 112 is caused to expand axially before the feed screw 22 entrains the carrier 16. When the dome 2 reaches its lower end position, the motor 21 can continue to move the feed screw 22 downwardly so that the coupling device 112 stores some energy and pulls the carrier 16 and the dome downwardly with a progressively increasing force before the motor 21 comes to a full stop. This ensures that the coupling device 112 can compensate for manufacturing and/or adjustment tolerances. The respective limit switch 111 then opens the circuit of the motor 21 in good time in order to avoid damage to the motor circuit.

If the contents of the booth 1 are on sale during an exhibition, in a department store or in a shopping mall, the operator in charge will repeatedly lift and lower the dome in order to make a sale and to thereupon reconfine the remaining goods. As mentioned above, the operator can remove or add shelves 66 so as to remove unnecessary storage area or to provide additional storage area, depending upon the number and dimensions of exhibited objects. In addition, such removal of empty shelves and addition of shelves for additional goods contributes to the eye-pleasing appearance of the entire booth.

The motor 86 which rotates the table 8 relative to the understructure 4 of the support 3 can be designed to turn the table at a constant speed or to change its speed during certain stages of angular movement of the table. This depends on the nature of the exhibited goods and on the interval of time which is required by an observer to grasp or take notice of the entire contents of the booth which are visible in a certain angular position of the table. In other words, the speed of the motor 86 will be selected in dependency on the nature and number of exhibited commodities.

Figure 28:
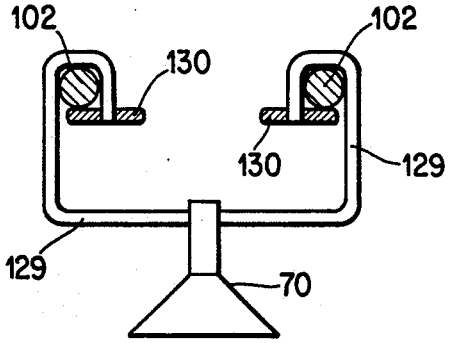
FIG. 28 is a fragmentary horizontal sectional view of a modified display booth wherein a reflector is mounted on two neighboring rail-shaped conductors.

FIG. 28 shows a modified structure which serves to support one or more light sources 70 on several upright rail-shaped conductors 102. The illustrated light source 70 is mounted on a substantially U-shaped bracket 129 having two legs the free end portions of which are bent around the respective rails 102 and are fixedly or slidably locked thereto by retaining members 130. The arrangement may be such that the members 130 frictionally engage the respective rails 102 and can be shifted along such rails in response to the application of a certain force which is exerted by the operator in order to raise or lower the respective light source or sources 70. The devices 130 can constitute screws which may be loosened prior to shifting of the bracket 129 along the rails 102.

As shown in FIG. 29, the motor 21 can be mounted in the understructure in the region of the lower end portion of the tubular guide 14. Such motor can receive electrical energy from a source of a-c current or from a source of polyphase current. It is further possible to design the motor 21 as a low-voltage motor which can be operated by energy supplied by the battery or batteries 79 (FIG. 3) in the internal compartment 6 of the support 3.

The control panel 82 constitutes a presently preferred device for initiating various movements of mobile parts, such as rotation of the table 8, upward or downward movements of the dome 2, operation of the motor or motors 78 in the cooling apparatus 73 and/or others. However, it is equally possible to provide an indirect connection between a control panel and the parts which are controlled thereby. For example, the control panel can include or constitute a sender which can be actuated to transmit signals by remote control to several receivers in the interior of the booth. Furthermore, the control panel 82 can be located at a remote location in a store or elsewhere and can be designed to transmit signals to the motor or motors in the booth. All such modifications will be readily appreciated by those familiar with the relevant art.

An important advantage of the improved display booth is its simplicity. Furthermore, an attendant standing next to the control panel 82 can raise or lower the dome 2 without inconveniencing the viewers of the displayed goods. This is particularly important if the displayed goods are on sale right from the booth, e.g., when a salesperson standing next to the control panel 82 must raise the dome 2 whenever a customer decides to purchase a displayed object, such as a fruit, candies, chocolate or other edible goods which are stored under the dome to prevent pilfering and/or to prolong their useful life. The dome 2 is or can be lowered after each sale, and each such manipulation involves a minimum of effort, especially if the booth is equipped with a prime mover which serves to move the dome up and down.

The improved booth can be used to display valuable goods, such as articles of jewelry, sophisticated cameras and other expensive commodities. The prime mover which moves the dome 2 up and down can be designed in such a way that it automatically locks the dome in its lower end position unless the operator inserts or actuates the key for the master switch 84. The provision of a prime mover is preferred in most instances because this simplifies the task of the attendant regardless of whether the attendant is in charge of selling the displayed goods or is there to consult interested viewers, e.g., as concerns the advantages of different types of cameras or the cost and/or possible uses of pieces of jewelry. Such person need not waste her or has time for manual lifting and lowering of the dome because a simple manipulation of the switch 84 suffices to activate the electrical or electronic system and the operator can then depress a selected button 83 of the panel 82 in order to select the direction of movement of the dome 2, to turn on one or more lights in order to provide additional illumination for a particular displayed object, to set the table and the dome in rotary motion, or to turn on or off the cooling apparatus 73.

The internal space of the dome can accommodate a fan or other suitable means for distributing the admitted cool air and/or to promote the expulsion of stale air. Cooling of the internal space 69 of the dome 2 is especially important and desirable when the table 8 and/or one or more shelves 66 are used to display expensive perishable, foodstuffs. At least intermittent cooling of the internal space 69 of the dome 2 may be desirable on the additional ground that the reflector or reflectors 70 will generate heat when they are turned on for longer periods of time. If the display booth is to be used outdoors, e.g., on a street, the current-consuming devices can receive energy from the energy source 79 in the internal compartment 6 of the support 3. Such energy source can include one or more rechargeable batteries or accumulators.

The improved display booth is susceptible of many additional modifications without departing from the spirit of the invention. For example, the marginal portion 89 of the dome 2 can constitute a simple cylinder which comes to rest on top of the table 8. The embodiments which are shown in FIGS. 3, 6, 8, 11, 12, 13, 14, 15, 22, 24 and 25 are preferred at this time because the cooperating inclined surfaces of the rim 11 of the table 8 and of the marginal portion 89 of the dome 2 ensure that the dome is automatically centered in the lower end position so that adequate sealing of the internal space 69 from the surrounding area 95 presents fewer problems. Moreover, automatic centering of the dome 2 in its lower end position contributes to eye-pleasing appearance of the entire booth.

The provision of one or more removable or shiftable shelves 66 in the internal space 69 is desirable and advantageous because the person in charge can readily display a larger or smaller number of objects and, if the number of displayed objects is reduced, the empty shelf or shelves can be removed to ensure that they do not detract from the appearance of the booth and of the displayed objects or goods. Still further, the shelf or shelves render it possible to gather related or identical objects into several eye-pleasing groups or into groups which enable a viewer to observe all of the cooperating components of a composite ensemble, e.g., an array including a necklace, one or more bracelets, earrings and rings. One or more sources of cold light can be installed in the internal space 69 of the dome if the utilization of such sources is beneficial to the displayed commodities. For example, sources of cold light can be installed in the region of one or more shelves 66.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A display booth comprising a support; a dome above said support, said dome having an internal space and a top portion and being movable with reference to said support up and down between a plurality of different positions; means for locating said dome in at least one of said positions including a substantially upright carrier for said dome and said carrier having an upper end portion disposed in said internal space adjacent the top portion of said dome, said carrier being movable up and down with said dome; and means for connecting said upper end portion with said top portion including a platform disposed in said internal space on said upper end portion adjacent said top portion, a cap overlying said top portion, said cap, top portion, and platform each having an opening in alignment with each other, and means for clamping said top portion between said platform and said cap including a threaded fastener having a top portion overlying the cap and a second portion which extends through said openings and into the upper end portion of said carrier.

2. The booth of claim 1, wherein said support includes a tubular guide extending into said space and reciprocably receiving said portion of said carrier.

3. The booth of claim 2, wherein said guide and said carrier have a common substantially vertical axis.

4. The booth of claim 2, further comprising at least one shelf adjacent said guide and disposed in said internal space.

5. The booth of claim 4, wherein said shelf has a substantially horizontal upper side and is supported by said guide.

6. The booth of claim 1, wherein said platform and the top portion of said dome define a clearance and further comprising a filler in said clearance.

7. The booth of claim 6, wherein said filler includes a plurality of hardened components of plastic material.

8. The booth of claim 1, wherein said cap has a substantially concave underside.

9. The booth of claim 1, wherein said platform has an underside and a sleeve extending from said underside, said carrier having an upper end portion in said sleeve.

10. The booth of claim 1, wherein said support includes a tubular guide and said portion of said carrier is reciprocable in said guide, said guide having an upper end portion and further comprising a second platform beneath the platform of said carrier, said second platform being mounted on the upper end portion of said guide and having an opening for said carrier.

11. The booth of claim 1, further comprising means for illuminating said internal space including at least one light source and means for supplying electrical energy to said light source.

12. The booth of claim 11, wherein said energy supplying means comprising at least one conductor extending in said space in substantial parallelism with said portion of said carrier.

13. The booth of claim 1, wherein said clamping means comprises a threaded fastener having a head overlying said cap and a threaded shank extending through registering openings provided therefor in said cap, in the top portion of said dome and in said platform and into a tapped bore of said carrier.

14. The booth of claim 1, wherein said support includes a tubular guide extending into said space and reciprocably receiving said portion of said carrier, and further comprising a bearing interposed between said guide and said portion of said carrier.

15. The booth of claim 1, wherein said support includes a substantially horizontal table beneath said dome, said table including a median panel, a top panel above said median panel and a bottom panel beneath said median panel, said panels having openings for said carrier.

16. The booth of claim 15, further comprising fastener means for securing said median panel to said bottom panel.

17. The booth of claim 15, further comprising means for moving said dome up and down including a motor in said support and means for mounting said motor on said median panel.

18. The booth of claim 17, wherein said mounting means includes at least one wall which extends from said median panel substantially vertically downwardly and carries said motor.

19. The booth of claim 1, wherein said carrier has a lower end portion and further comprising means for moving said dome up and down through the medium of said carrier, including a reversible motor installed in said support and having a rotary feed screw connected with the lower end portion of said carrier.

20. The booth of claim 1, further comprising means for moving said dome up and down including a substantially vertical toothed rack provided on said carrier and disposed in said support, a reversible motor in said support, and a pinion driven by said motor and mating with said rack.

21. The booth of claim 1, wherein said support includes an upright tubular guide for said portion of said carrier, a substantially horizontal table disposed beneath said guide and including a panel, and means for coupling the lower end of said guide to said panel including a substantially platelike bearing member on the lower end portion of said guide, a pedestal between said panel and said bearing member, and fastener means securing said pedestal to said bearing member and said panel.

22. The booth of claim 1, further comprising a substantially upright tubular guide for said portion of said carrier, at least one shelf provided in said space in the region of said guide, at least one electrical conductor provided in said space and extending in substantial parallelism with said guide, and means for separably coupling said shelf to said conductor.

23. The booth of claim 22, wherein said conductor includes an elongated rail and said coupling means includes means for clamping said shelf to said rail.

24. The booth of claim 1, wherein said support includes a substantially horizontal table on which said dome comes to rest in one of said positions thereof and an understructure supporting said table from below and defining at least one internal compartment.

25. The booth of claim 24, wherein said understructure includes a substantially upright hollow cylindrical wall.

26. The booth of claim 24, wherein said table has a substantially circular outline.

27. The booth of claim 24, further comprising means for cooling said internal space including a cooling apparatus installed in said compartment.

28. The booth of claim 27, wherein said cooling apparatus includes a cooling element in or on said table.

29. The booth of claim 27, wherein said cooling apparatus includes a cooling element beneath said table.

30. The booth of claim 24, wherein said table includes a vessel having an open top facing said internal space, said support further including a tubular guide extending upwardly of said table and into said internal space, said vessel having a substantially centrally located collar surrounding said guide.

31. The booth of claim 30, wherein said table includes a plurality of substantially horizontal panels and said vessel has a bottom wall constituting one of said panels.

32. The booth of claim 1, further comprising an open-top vessel provided on said support and being confined in said internal space in one of said positions of said dome, and further comprising a cooling apparatus including a cooling element adjacent or in said vessel.

33. The booth of claim 32, wherein said support includes a table on which said dome rests in said one position, thereof and further comprising heat insulating means interposed between said vessel and said table.

34. The booth of claim 32, wherein said vessel has an outlet and further comprising a liquidscollecting receptacle disposed in said support and arranged to receive liquids from said outlet.

35. The booth of claim 1, wherein said support includes an apertured table which supports said dome in one of said positions of the dome, and further comprising means for cooling said internal space including an air cooling apparatus in said support and means for conveying cool air from said apparatus to the apertures of said table for penetration into said space.

36. The booth of claim 1, wherein said support has a substantially horizontal table on which said dome rests in one of said positions thereof, and further comprising means for evacuating air from said internal space.

37. The booth of claim 1, further comprising at least one current-consuming device and means for controlling the flow of current to said device including a control panel in the region of said support.

38. The booth of claim 37, wherein said controlling means includes at least one key-operated switch.

39. The booth of claim 1, wherein said support includes a table on which said dome comes to rest in one of said positions thereof, said table having a rim including an upwardly extending first portion and a downwardly extending second portion.

40. The booth of claim 1, wherein said support includes a table on which said dome comes to rest in one of said positions thereof and a tubular guide for said carrier, and further comprising means for separably connecting said guide with said carrier and with said table.

41. The booth of claim 1, wherein said support includes a substantially horizontal table on which said dome comes to rest in one of said positions thereof, said table including a rim having an inclined supporting surface for said dome.

42. The booth of claim 41, wherein said dome has a vertical symmetry axis and said supporting surface has an upper portion more distant from and a lower portion nearer to said axis.

43. The booth of claim 41, wherein said dome has a vertical symmetry axis and said supporting surface has an upper portion nearer to and a lower portion more distant from said axis.

44. The booth of claim 41, wherein said dome has a marginal portion provided with a flange which abuts said rim in said one position of said dome.

45. The booth of claim 41, wherein said dome has an inwardly extending annular marginal portion in the region of said rim.

46. The booth of claim 41, wherein said dome has an outwardly extending annular marginal portion in the region of said rim.

47. The booth of claim 41, wherein said dome has a marginal portion including a first section disposed above and abutting said rim and a tubular second section surrounding said rim and sloping downwardly and inwardly toward the periphery of said rim.

48. The booth of claim 1, wherein said support includes a substantially horizontal table having a rim on which said dome comes to rest in one of said position's thereof, and further comprising annular sealing means interposed between said rim and said dome.

49. The booth of claim 1, wherein said support includes a table having a rim on which said dome comes to rest in one of said positions thereof, said dome having at least one handgrip portion provided in the region of said rim to facilitate the moving of the dome up and down relative to said table.

50. The booth of claim 1, wherein said dome is movable between predetermined upper and lower end positions and further comprising means for moving said dome and means for arresting said moving means in at least one end position of said dome.

51. The booth of claim 50, wherein said moving means comprises a reversible electric motor in said support and said arresting means includes a limit switch installed between said carrier and said motor.

52. The booth of claim 51, wherein said moving means includes a reversible electric motor and said arresting means includes an electronic switch having means for evaluating the quantity of electrical energy which is supplied to said motor.

53. The booth of claim 1, further comprising means for moving said dome up and down relative to said support including a prime mover and means for connecting said prime mover with said dome, said connecting means including a first portion movable by said prime mover, a second portion connected with said carrier, and an elastic coupling between said first and second portions.

54. The booth of claim 53, wherein said coupling includes a coil spring.

55. The booth of claim 1, wherein said support includes a substantially horizontal table on which said dome comes to rest in one of said positions thereof, and further comprising means for rotating said table about a substantially vertical axis.

56. The booth of claim 55, wherein said support includes a hollow understructure beneath said table and said rotating means is disposed in said understructure.

57. The booth of claim 1, wherein said carrier has an asymmetrical peripheral surface.

58. The booth of claim 1, wherein said support has an external surface and at least one protective coat on said external surface.

59. The booth of claim 1, wherein at least a portion of said dome consists of acrylic glass.

60. The booth of claim 1, further comprising means for releasably locking at least one of said positions thereof, said support having a substantially horizontal table on which said dome comes to rest in said one position thereof and said table having a rim, said dome having a marginal portion which is adjacent said rim in said one position of said dome and said dome further having at least one handgrip means in the region of said marginal portion thereof, said locking means including means for releasably securing said marginal portion to said rim in the region of said handgrip means.

61. The booth of claim 1, wherein said support includes a substantially horizontal table on which said dome comes to rest in one of said positions thereof, said table including a vessel having an open top facing the interior of said dome, said support further including an upright tubular guide for said portion of said carrier and said guide extending upwardly from said table, said, vessel having a substantially centrally located collar surrounding said guide and said guide having a lid overlying at least a portion of said collar.

62. The booth of claim 1, wherein said support defines an internal compartment beneath said dome and includes at least one door which affords access to said compartment.

63. The booth of claim 1, wherein said support includes a substantially horizontal table on which said dome comes to rest in one of said positions thereof and a hollow understructure beneath said table, said understructure including at least one drawer.

64. The booth of claim 1, wherein said support includes a table on which said dome comes to rest in one of said positions thereof, said table having a rim and further comprising means for suspending decorative material on said rim.

65. The booth of claim 1, wherein said support includes a table on which said dome comes to rest in one of said positions thereof and said support further comprising a tubular guide for said portion of said carrier, and further comprising means for moving said dome and said carrier up and down including a prime mover adjacent said guide.

66. The booth of claim 1, further comprising means for moving said dome including a low-voltage electric motor.

67. The booth of claim 1, further comprising means for moving said dome up and down and means for regulating the operation of said moving means including a control panel provided in the region of said support and means for transmitting signals from said control panel to said moving means by remote control.

* * * * *